US006585118B2

(12) United States Patent
Kellogg

(10) Patent No.: US 6,585,118 B2
(45) Date of Patent: Jul. 1, 2003

(54) DISPLAY SYSTEM FOR DEATH CARE MERCHANDISE

(76) Inventor: Douglas E. Kellogg, 8161 Basil Western Rd., Canal Winchester, OH (US) 53110

( * ) Notice: Subject to any disclaimer, the term of this patent is extended or adjusted under 35 U.S.C. 154(b) by 0 days.

(21) Appl. No.: 09/812,427

(22) Filed: Mar. 20, 2001

(65) Prior Publication Data

US 2002/0033372 A1 Mar. 21, 2002

Related U.S. Application Data

(60) Provisional application No. 60/190,843, filed on Mar. 20, 2000.

(51) Int. Cl.[7] ..... A47F 7/00
(52) U.S. Cl. ..... 211/13.1; 211/85.16; 211/189
(58) Field of Search ..... 211/85.16, 13.1, 211/189, 135, 149, 195

(56) References Cited

U.S. PATENT DOCUMENTS 4,114,965 A * 9/1978 Oye et al. ..... 312/209
5,031,781 A * 7/1991 Price et al. ..... 211/128.1
5,297,011 A * 3/1994 Triunfol ..... 362/147
5,524,394 A 6/1996 Szabo et al.
5,706,959 A * 1/1998 Smith ..... 248/174
5,901,862 A * 5/1999 Riga et al. ..... 211/85.16
5,960,966 A 10/1999 Riga et al.
6,145,671 A * 11/2000 Riga et al. ..... 211/85.16
6,170,674 B1 * 1/2001 Caterinacci ..... 211/41.1

FOREIGN PATENT DOCUMENTS

DE 4440978 A1 * 5/1996 ..... A47F/7/02

* cited by examiner

*Primary Examiner*—Daniel P. Stodola
*Assistant Examiner*—Erica B Harris
(74) *Attorney, Agent, or Firm*—Francis T. Kremblas, Jr.; Kremblas, Foster, Phillips & Pollick

(57) ABSTRACT

A modular display system for death care merchandise includes a pair of vertically extending, free-standing, laterally spaced, side wall members. Each side wall member comprises a pair of lateral spaced, parallel side panels connected to one another to form a forwardly open chamber between the side panels. A rear wall extends across the rear portion of the side wall members to form a three-sided, alcove-like configuration. The rear wall may take several forms depending upon a variety of shelving designs for displaying a variety of death care products in an efficient, attractive manner. A slidably mounted, vertically oriented, slide-out display panel or drawer may be inserted into the chamber formed between the side panels of a side wall member and a decorative front cover may be removably mounted over each side wall member to create an aesthetically pleasing appearance. The front cover also includes a rearwardly directed flange portion which forms an interior facing elongate channel in cooperation with portions of the side panel to house a vertically oriented lighting assembly.

12 Claims, 29 Drawing Sheets

DISPLAY SYSTEM FOR DEATH CARE MERCHANDISE

CROSS-REFERENCES TO RELATED APPLICATIONS

This application claims the benefit of U.S. Provisional application No. 60/190,843 filed Mar. 20, 2000.

BACKGROUND OF THE INVENTION

1. Field of the Invention

The present invention relates to a display system for merchandise related to the death care industry. Such merchandise includes, for example, caskets, urns, burial vaults and related accessories.

2. Description of Related Art

Display systems of this general type are known in the prior art and range from relatively rudimentary two tier displays for showing one casket above another to more recent modular systems such as shown in U.S. Pat. Nos. 5,524,394 and 5,960,966 and in the patent references cited therein. The latter systems are quite similar and involve forming a three-sided alcove configuration wherein a pair of vertical side walls are secured to a rear wall to support the side walls in their spaced vertical condition. Each wall is alleged to be constructed in a manner which renders the display system to be readily assembled and provide viewing of the merchandise in a more pleasant environment than the means used prior thereto.

While these more current display systems represent some improvement over those of earlier vintage, there still exists a need for improvement in modular design of a display unit, which not only enhances manufacture and installation in a variety of different configurations adapted for showing different types of merchandise, but which incorporates flexibility in function in an economical and more aesthetically pleasing design.

SUMMARY OF THE INVENTION

The present invention comprises a pair of independent or free-standing side wall structures laterally spaced in parallel relationship to one another. Each such side wall structure includes a pair of vertically disposed side panels connected to one another in parallel spaced relationship forming a chamber between the panels and permitting each to stand free and independent of one another. This permits use of a variety of different types of rear walls to form a background between the side walls and a variety of configurations to better display death care products in a three sided appearing enclosure or alcove-like configuration. This permits great flexibility in design of the display system to accommodate a very aesthetic display arrangement for a wide range of merchandise related to the funeral home industry, and yet incorporates a significant amount of standardized component structures to yield benefits in manufacturing and installation economics.

The free-standing side walls may incorporate a novel vertically oriented display panel or drawer which is slidably mounted in the space or chamber formed between the pair of side panels of a side wall structure. This feature provides a very attractive means to display samples of interior casket decorations and accessory items and add to the overall aesthetic appearance of the display structure.

As another aspect of the display system of the present invention, a decorative front cover may be removably fixed to the forward edges of the side walls to not only provide an attractive column-like, aesthetic appearance but further may include a lateral extension beyond the side walls. At least one of these lateral extending portions preferably includes a rearwardly extending flange disposed along most of the entire vertical height of the front cover. This flange, the lateral extending portion of the front cover, and the inner facing side wall of the side panel form a channel which conveniently houses a vertical extending lighting assembly which efficiently and attractively directs light to the interior of the alcove display arrangement.

In another preferred embodiment of the present invention, plural, vertical spaced, horizontal shelves may be mounted between the side panels. Each shelf may include a rear panel or wall connected to a horizontal bottom shelf upon which a full or partial casket display may be supported. The rear panel of these shelves may conveniently serve as part of a rear wall of the alcove structure in conjunction with the free-standing side walls in an economical and aesthetically attractive manner.

In another preferred embodiment of the present invention, the above described free-standing side walls are provided with a base or deck removably fixed to and extending between the side wall panels and incorporating a slidably mounted horizontal shelf member incorporated with the base such that a full casket supported on the slidable shelf may be moved between retracted and extended positions for selective viewing. This is particularly applicable to conserve space when a second shelf displaying a second casket is disposed above the slidable shelf assembly to permit appropriate display of both caskets in a space saving arrangement. Preferably the slidable shelf assembly and the upper shelf each include wall panels which cooperate with one another to form a rear panel extending between the free-standing side wall to provide a selected attractive background for the merchandise display and as well as a different manner to form the alcove-like configuration in an economical manner.

In another preferred embodiment of the present invention, the pair of free standing sidewalls are employed with a rear wall provided with slots or grooves, commonly referred to as a "slat wall", to display miniature burial vaults and accessories. This is a further example of the flexibility in design and ease of changing from one display arrangement to another using the basic free-standing side wall configuration.

As an aspect of another preferred embodiment of the present invention, the two free-standing side walls described above herein may be employed with a base member connected to each of the side walls and a vertical rear wall extending across the side walls to provide an alcove-like appearance. The lower end of the rear wall is supported by an angle fixed to the rear of the base and a cornice assembly, which may be removably mounted across an upper portion of the side spaced side walls. The upper end of the rear wall may be fixed to the cornice assembly via an angle support structure. A plurality of parallel, spaced dividers extending between the base member and the cornice and a plurality of individual shelves spanning between the dividers and the side walls provide a space saving, attractive. arrangement to display urns and related accessories in a very aesthetically pleasing manner.

It is an important object of the present invention to provide a display system for death care merchandise that is not only of modular construction, but provides an improved, aesthetically pleasing appearance to the consumer and yet maintains structural stability, ease of installation, flexibility to accommodate various types of merchandise in a variety of selected side by side configurations and also may be manufactured and installed at relatively low cost.

BRIEF DESCRIPTION OF THE DRAWINGS

FIGS. 15-A and 15-B are isolated perspective views illustrating one form of conventional J-clips useful to mount the rear panel to the shelves of the unit shown in FIG. 10;

FIG. 15-C is an isolated front elevation view illustrating the rear or back panel shown in FIG. 15 apart from the remaining structure;

FIG. 19-A is an exploded view of a pair of conventional bed fittings used in the unit shown in FIG. 18;

FIGS. 30-A and 30-B are perspective views of components of a conventional fastener device used in the construction of the unit shown in FIG. 29;

DESCRIPTION OF THE PREFERRED EMBODIMENT

Figure 1:
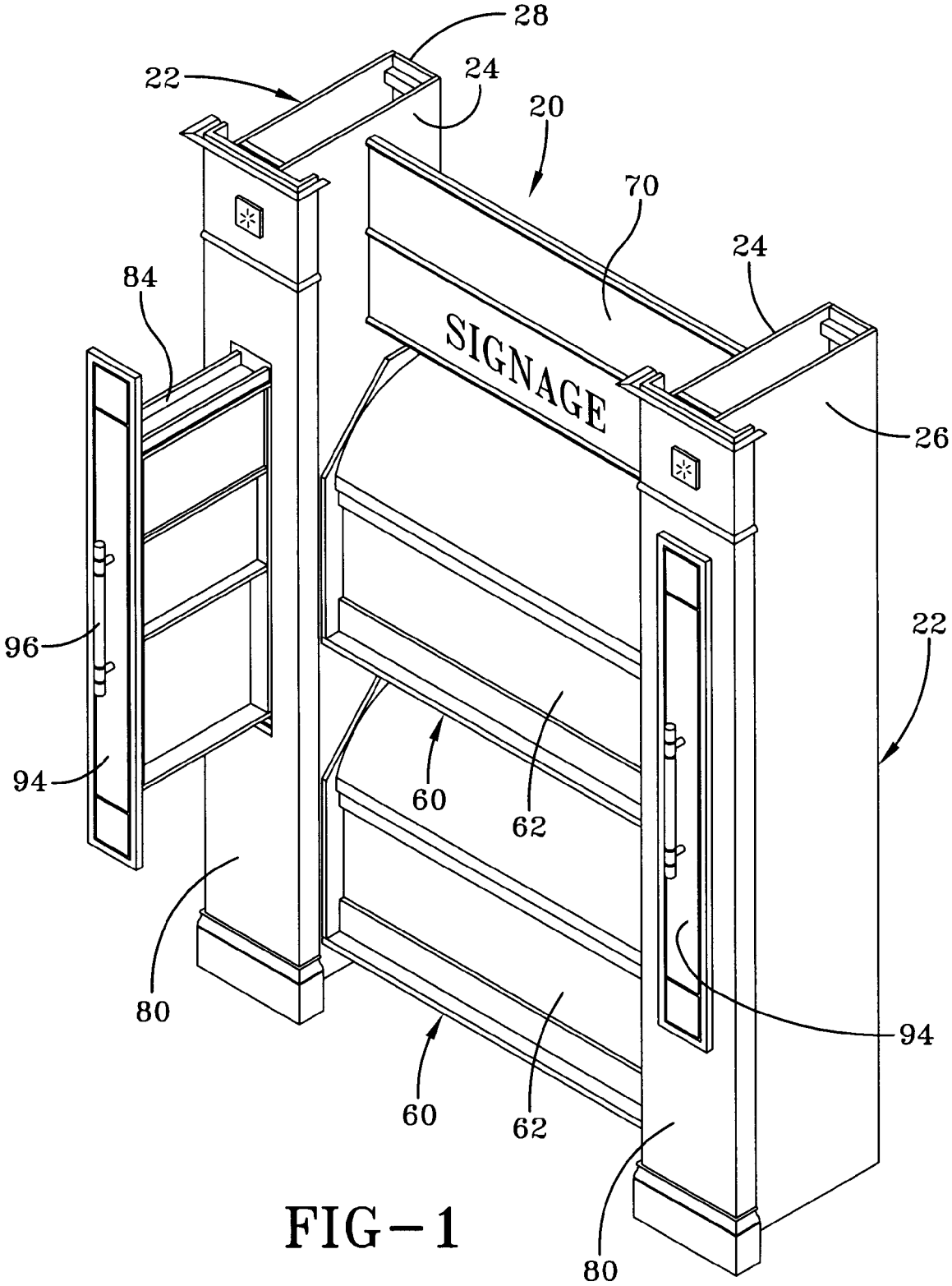
FIG. 1 is a perspective view of a preferred embodiment of the present invention illustrating a partial casket display unit.

A display unit, indicated generally at 20, for death care products constructed in accordance with the present invention is shown in FIG. 1 and includes a pair of vertically extending, parallel and laterally spaced side wall members 22. Each side wall member 22 comprises a pair of laterally spaced side panels 24 and 26 and a rear panel 28, which may be conventionally fixed in a suitable manner to the rearward edges, as shown in FIG. 1, of side panels 24 and 26 to form free-standing side wall structure 22. The term free-standing as used herein means each side wall member 22 is capable of independently supporting itself in the vertical disposition shown.

Figure 2:
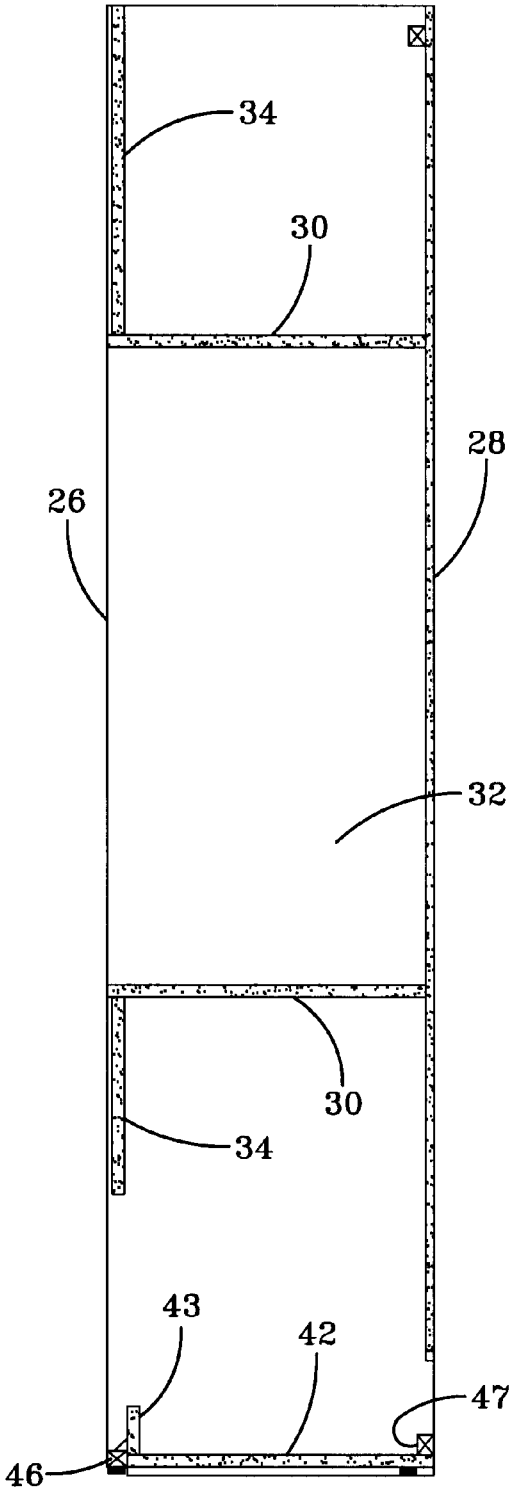
FIG. 2 is a partial side sectional view of one of the free-standing, side walls of the display unit shown in FIG. 1 forming a portion of the present invention, the section being taken along line 2—2 in FIG. 3.
Figure 3:
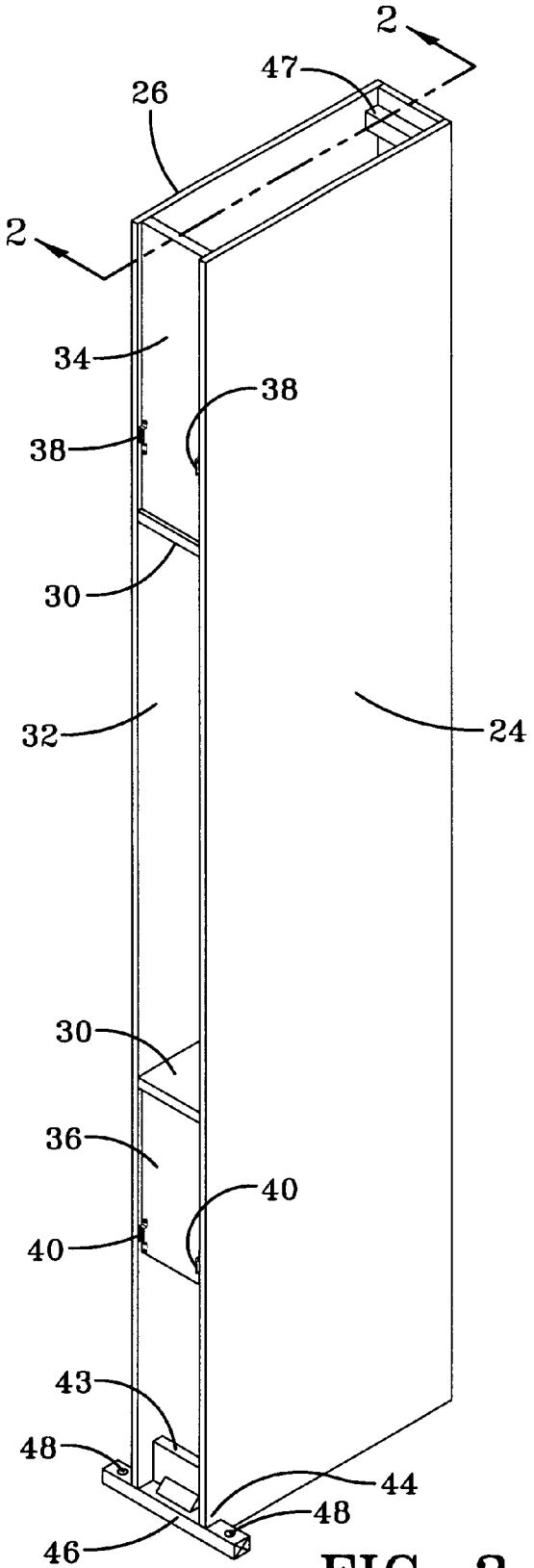
FIG. 3 is a perspective view of the side wall shown in FIG. 2.

As seen in FIGS. 2 and 3, each side wall member 22 preferably includes horizontally disposed, vertically spaced brace members 30 which may be fixed to side panels 24 and 26 in any suitable conventional manner, such as by nails, staples, adhesives, or threaded fasteners, for example.

Members 30 function to add stability to the respective side members 22 and may be used to define a chamber 32 in the space between side panels 24 and 26 to accommodate a pullout display panel or drawer as described in detail later herein.

A pair of vertically spaced forward panels 34 and 36 are fixed to each side wall member 22, such as shown in FIGS. 2 and 3, using any suitable conventional fastening means such as earlier mentioned herein so as to be closely spaced to or nearly flush with the forward edges of side panels 24 and 26. Panels 34, 36 may also be fixed to a respective one of braces 30 if desired.

Each panel 34 and 36 is preferably provided with a pair of conventional knock down type or KD fitting receptacles, such as 38 and 40, which are adapted to mate with male counterparts carried by a front cover as will be described in detail later herein.

Preferably each side wall 22 includes a bottom panel 42 fixed along its longitudinal edges to side wall panels 24 and 26 in a similar conventional manner as braces 30, such as by conventional construction staples, for example.

The forward bottom edge of each side panel 24 and 26 is provided with an L-shaped cut out portion, such as at 44. Cut out portions 44 accommodate a foot, such as block 46, provided with oppositely disposed conventional threaded levelers 48. Threadably turning levelers 48 adjusts the horizontal disposition of the side wall panels 24 and 26 relative to the surface upon which side wall member 22 rests in a well-known conventional manner. If deemed desirable, additional threaded levelers may also be conventionally installed in the bottom panel 42 at any conveniently suitable location to permit suitable leveling of the side wall member 22 relative to the floor surface upon which members 22 rest. Any suitable form of conventional leveling devices, which provides equivalent results, may be used without departing from the spirit of the present invention.

Preferably, reinforcing members 47 may be fixed to the upper and lower rear portion of each side panel 22 to provide additional strength and stability if deemed appropriate for a given application.

Figure 4:
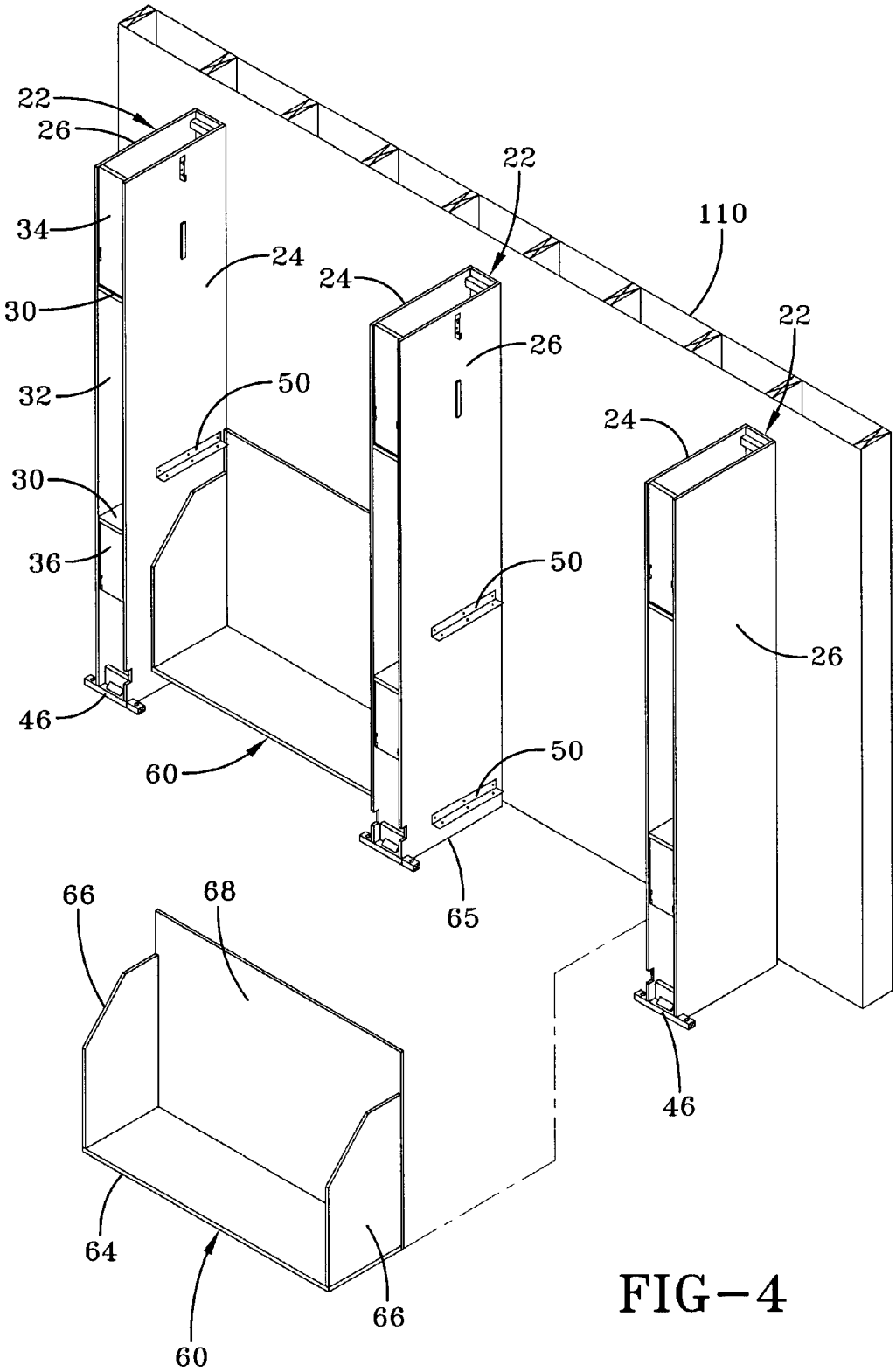
FIG. 4 is a partial perspective view of the display unit of FIG. 1 illustrating details of mounting the shelves to the freestanding side wall.

As seen in FIG. 4, three or more side wall members 22 may be laterally spaced such that one of the members 22 functions as the counterpart of a spaced pair of wall members 22 in cooperation with the wall member 22 located adjacent thereto to form a plurality of side by side display units.

In the preferred embodiment shown in FIG. 1, the inwardly facing side panels 24 are each provided with a pair of vertically spaced conventional angle iron supports 50. Each of the pair of supports 50 is horizontally aligned with the opposing angle supports 50 on the opposing side panel 24 in order to support the bottom of a shelf, such as 60, between the side panels 24 in a generally horizontal position as shown.

Angle supports 50 may be fixed to the side panels 24 in any conventionally suitable manner that provides the necessary strength to support a shelf, such as 60, and the death care product to be placed on the shelf 60.

For example, in the embodiment shown in FIG. 1, the preferred product for display is a partial casket 62 resting upon each one of a pair of vertically spaced shelves 60. The partial casket preferably represents a quarter of a full casket displaying an end, top, and side portion thereof in a conventional well-known manner in the trade.

Each of the angle supports 50 are provided with appropriate spaced holes or openings aligned to mate with one or more dowels, not shown, provided on and extending from the bottom surface of a respective one of shelves 60 to removably fix the shelves 60 to the supports 50. Preferably, the bottom surface of each shelf 60 may also include one or more threaded inserts, such as at 64, to receive a threaded fastener 65 inserted through an aligned opening or hole in angle support 50 to mate with insert 64 to provide a more secure, yet removable assembly. Alternatively, a through hole in shelf 60 adapted to receive a recessed threaded fastener locking nut assembly may also be employed for a similar purpose.

Each shelf 60 is provided with side panels 66 and a vertically extending back panel 68, both conventionally fixed to shelf 60 in any suitable conventional manner along the side and rear edge thereof to form a unitary structure. Staples, nails, threaded fasteners or any other conventional attachment means may be employed.

Therefore shelves 60, as shown with back panels 68, provide the desired background for display purposes as they may be painted, textured, or covered with a cloth or other form of decorative trim as deemed desirable. Further, there is no need for a separate full back panel or wall in this particular embodiment in order to cover the wall of the room in which the display system is installed or to provide a desirable background panel for a display system set up in the middle of a room away from the room walls.

For aesthetic purposes, as well as to provide additional space for information concerning the type of casket displayed, it is preferred to install a signage panel 70 between the side panels 24 and above the rear wall 68 of the uppermost shelf 60.

Signage panel 70 may be mounted in any conventional manner, however, it is preferred to removably mount the panel 70 for ease of assembly by employing fastening means, such as conventional bed fittings, which are well-known to those in the art. Such fittings include a female member which may be fixed to one of panel 70 or to the surface of side panel 24 and a cooperating male fitting fixed to the other of such locations. One suitable example of such fittings is shown in the prior U.S. patents cited earlier herein. The attachment between the signage panel 70 and side panel 24 may then be accomplished by a simple vertical relative movement between the signage panel 70 and the side panels 24 to engage the respective aligned bed fitting components to one another to hang the panel 70 preferably in a position slightly forward of the rear panel 68 of uppermost shelf 60.

The described assembly provides an attractive and easily installed assembly serving as a rear wall or panel to form an alcove type display system.

Figure 7:
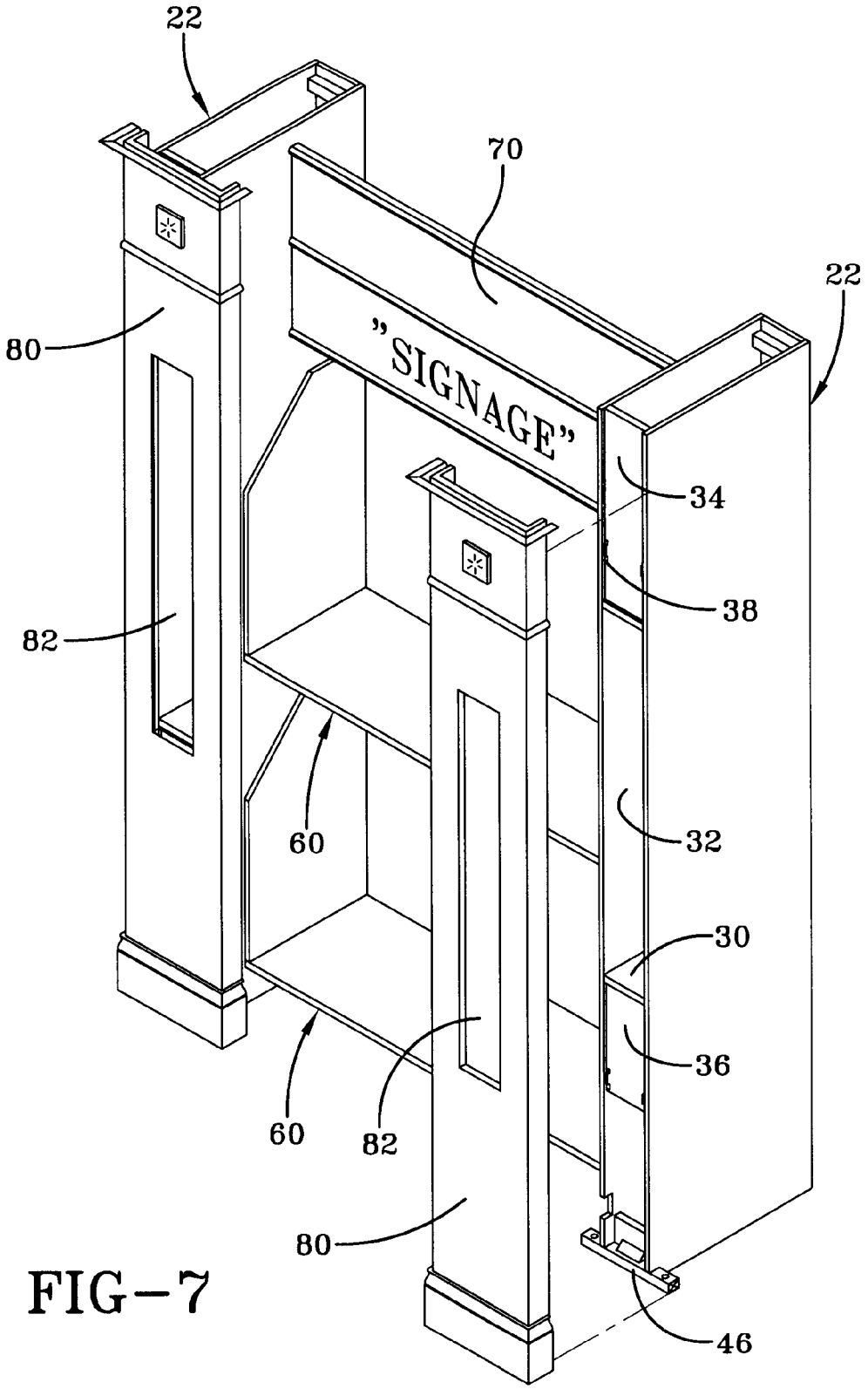
FIG. 7 is a partial perspective view similar to that shown in FIG. 6 illustrating the mounting of the removably mounted front covers on the free-standing side walls.
Figure 8:
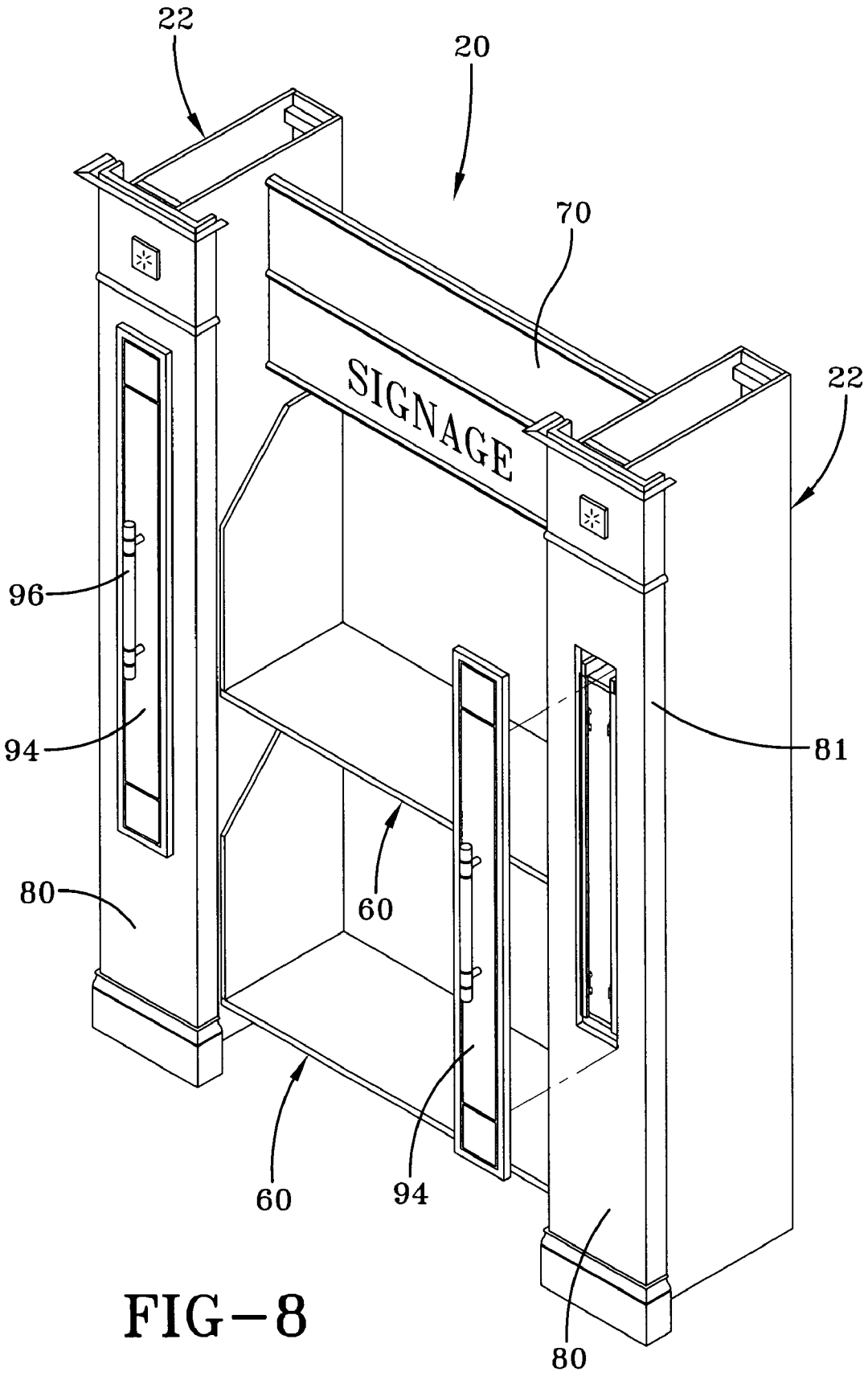
FIG. 8 is a perspective view of the units shown in FIG. 1 illustrating the mounting of the cover faces and handle to the pull-out display panel.
Figure 9:
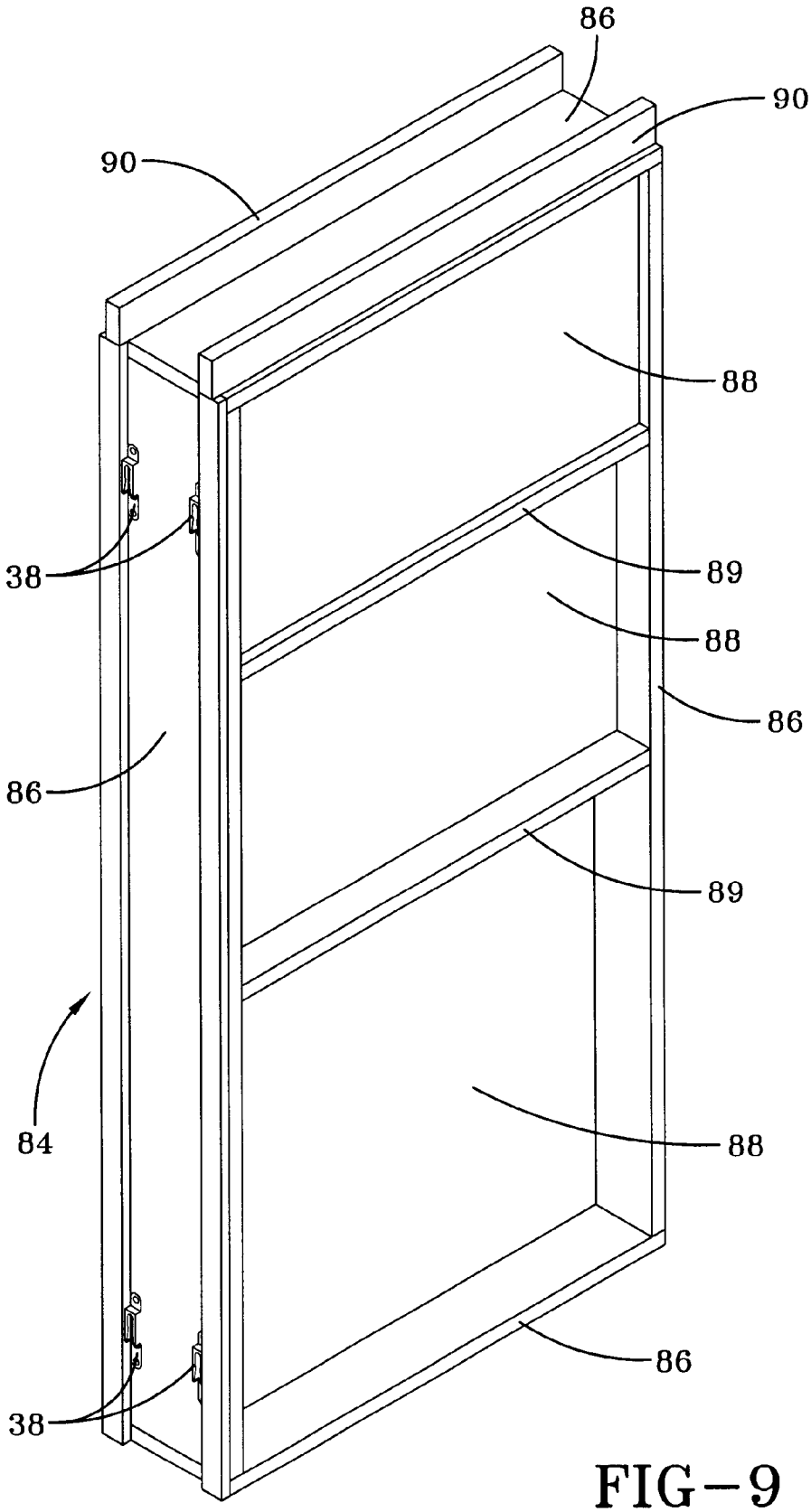
FIG. 9 is a perspective view of the pull out panel or drawer shown removed from the remaining structure of the display unit shown in FIG. 1.

Now referring to FIGS. 7 and 8, each side wall 22 is preferably provided with a removably mounted front cover or face 80 providing the forward end of each side wall 22 with a pleasing, highly aesthetic roman or greek column-like appearance and tends to "dress up" the display of the rather somber merchandise setting in a funeral home. Front face 80 includes a longitudinal slot or opening 82 in the embodiment shown in FIG. 1 to accommodate a panel or drawer 84 slidably disposed within chamber 32 of a respective one of side wall members 22. Drawer 84, as best seen in FIG. 9, is of a simple rectangular box-like configuration having four sides 86 enclosing a bottom wall 88 provided with horizontal dividers 89. As shown in FIG. 9, a pair of laterally spaced, vertically extending members 90 are fixed to the top wall 86 of drawer 84 forming a channel or recess to accommodate a conventional drawer or pull-out panel slide mechanism, not shown, operatively mounted to upper brace 30 and the lower wall 86 of drawer 84. The primary purpose of members 90 is to merely obscure the slide mechanism from the view of consumers viewing the products mounted on drawer 84 in its extended position. A preferred conventional slide mechanism for use is of the type comprising a pair of elongate members having slidably engaging U-shaped channels and L-shaped brackets to adapt the slide mechanism for the vertically oriented pull-out panel. Such conventional slide mechanism are widely commercially available, such as those sold by Accuride International, Inc. of Sante Fe Springs, Calif. However, any well-known conventional means suitable for slidably mounting drawer 84 in the vertical attitude shown within chamber 32 is within the spirit of the present invention.

Front face 80 is preferably removably mounted to the front of each side wall 22 via conventional fastening means, such as the well-known KD type fasteners which include pairs of female receptacles, 38 and 40, each pair being located on a respective one of front panels 34 and 36. An aligned pair of the mating male components of KD type fasteners in the form of a stud-like projection, not shown, are fixed to the inner surface of front cover 80 such that the covers 80 may be installed by simply positioning the cover 80 so that the pair of male components are slightly above the respective female components 38 and 40. Upon pushing the cover 80 inwardly and downwardly, both the upper and lower pair of KD fasteners become engaged in a manner well known to those of ordinary skill in the art.

Upon installing the respective pull-out drawers 83 and front covers 80, preferably a decorative facing 94, including a handle 96, are mounted to the forward facing side of drawer 84 by the conventional expedient of vertical spaced pairs of KD fasteners, such as the female receptacles shown at 38 in FIG. 9; These receptacle 38 receive male counterparts fixed to the inwardly facing surface, not shown, of face 94 so that face 94 may be removably mounted to drawer 84 in the same manner as earlier described above with respect to mounting front covers 80 to side wall members 22.

Figure 5:
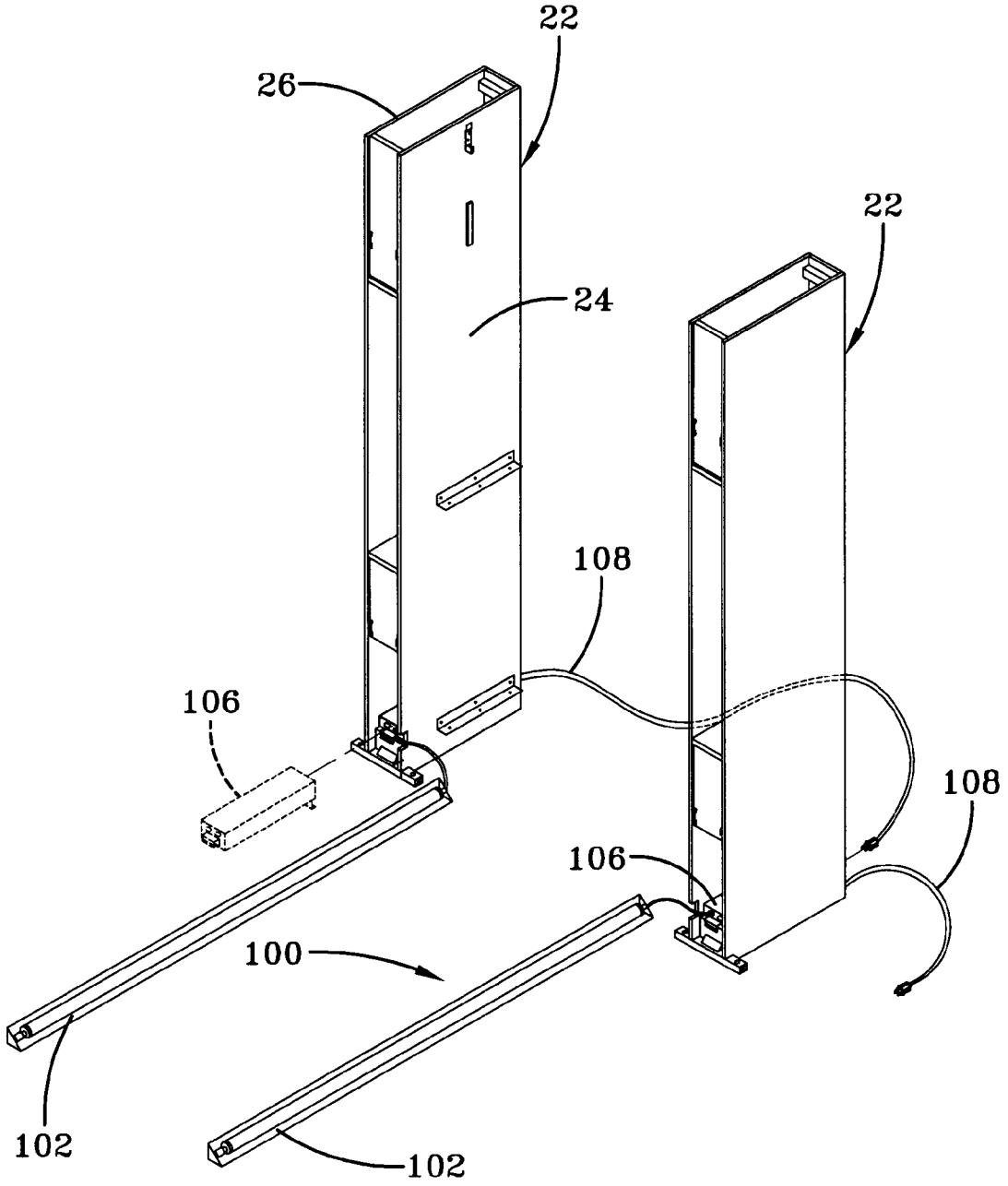
FIG. 5 is a partial perspective view of the display unit shown in FIG. 1 with the front cover removed to illustrate installation of light assemblies of an embodiment of the present invention.
Figure 6:
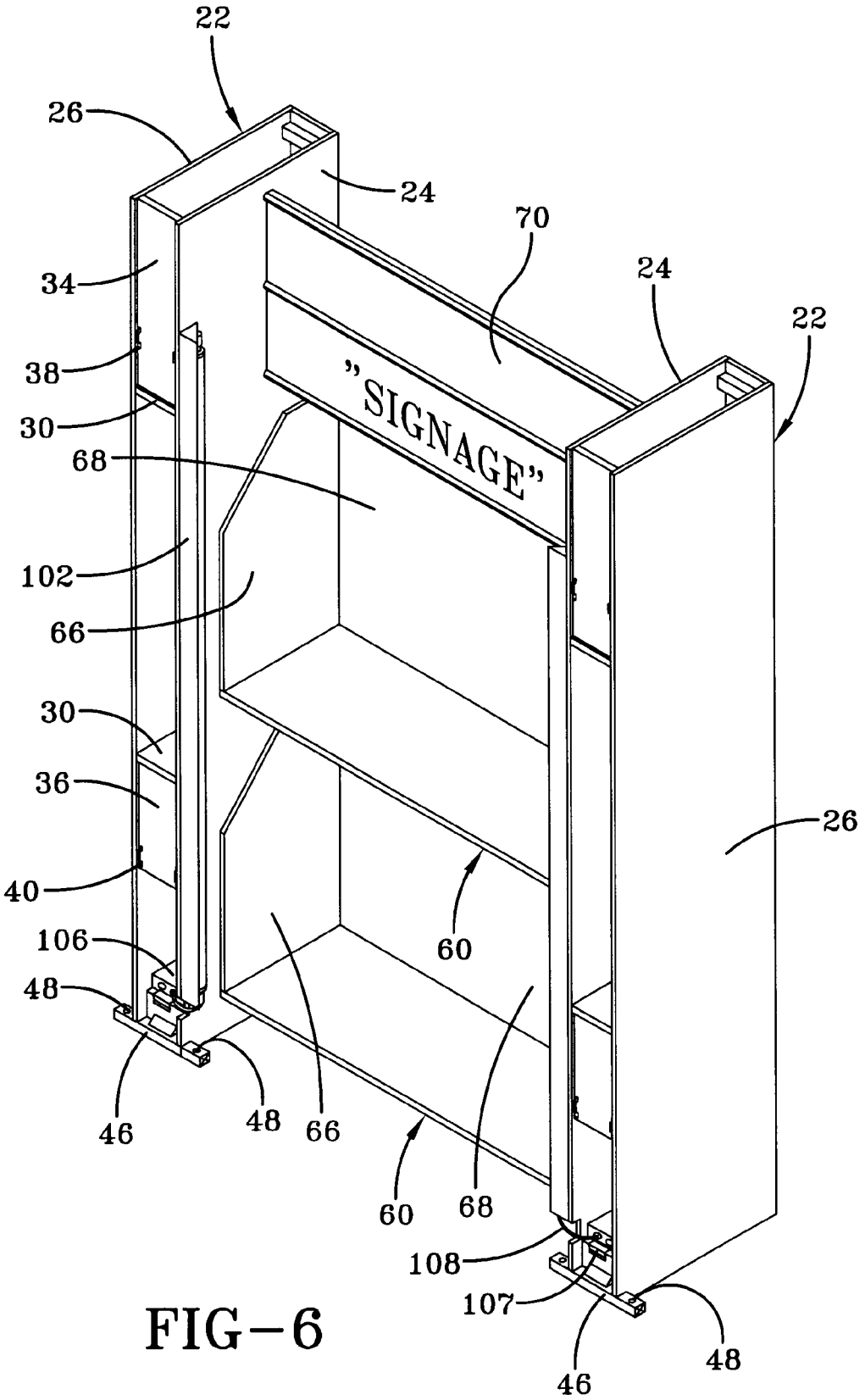
FIG. 6 is a partial perspective view of the display unit shown in FIG. 1 illustrating the light assemblies installed within the display unit with the front cover faces of each side wall being removed.
Figure 17:
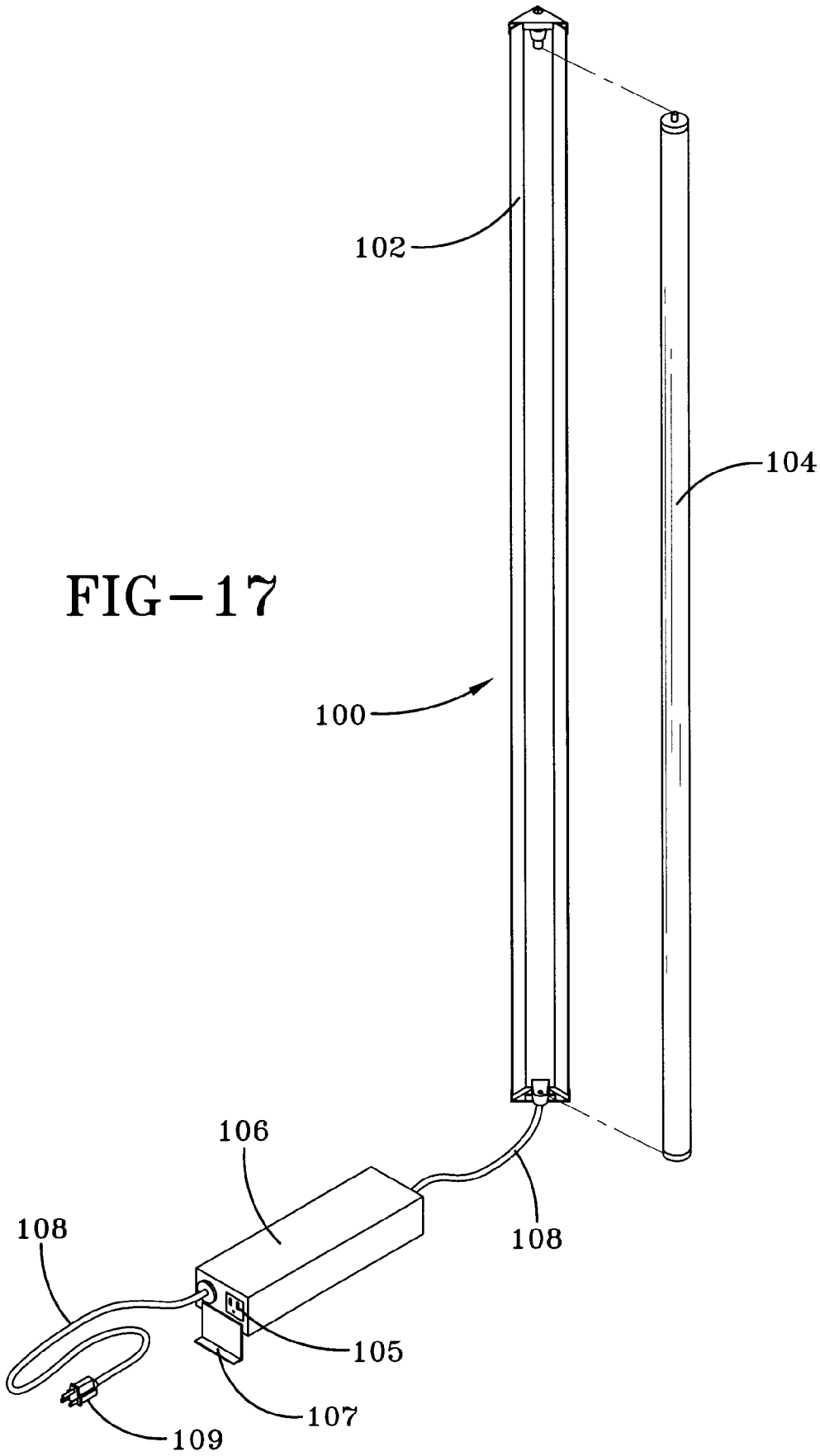
FIG. 17 is a perspective exploded view showing a lighting assembly in isolation from the remaining structure which is mounted on the embodiments shown in FIGS. 1 and 10.

Prior to installing front covers 80, a pair of conventional florescent light assemblies 100 are preferably used and installed in a vertically disposed position along a forward portion of each inwardly facing panel 24 as shown in FIGS. 5, 6 and 17. The light assembly 100 comprises a conventional fixture 102 that receives an elongate bulb 104 and a ballast box 106. The latter conventionally includes a plug outlet 105. An electrical cord 108 including a plug conventionally connects the ballast box 106 to the fixture 102 and a conventional source of electrical power.

The ballast box 106 is positioned in a cavity within side wall 22 below chamber 32 such that the clip 107 may be attached in any suitable conventional manner to cross block 43 which is fixed to bottom panel 42 of side wall 22. Upon installing a ballast box 106 in each side wall 22, cord 108 may be extended through to exit the rear of side wall 22. The respective cords 108 of each ballast box 106 may be connected in parallel or series to a wall outlet. In a series connection, the plug 109 from one ballast box is simply extended from one side wall 22 into the adjoining side wall 22 and plugged into the outlet of the other ballast box 106, with the electrical cord 108 of the other ballast box connected to an electrical wall outlet, not shown.

The fixture 102 may be installed with one of its sides placed adjacent to a forward edge of a side panel 24 and fixed thereto using conventional screws or any other suitable conventional fastening means. Then bulb 104 may be conventionally installed into fixture 102. It should also be noted that upon the assembling front cover 80, as described above herein, the width of front cover 80 is greater than the width of the front face of side wall 22 such that a portion of front cover 80 extends beyond the width of side wall 22. Cover 80 also includes rearwardly directed flange-like extensions 81 on opposing sides of cover 80. Flanges 81 extend vertically almost the entire height of side wall 22 to define a vertically extending channel comprising part of the cover 80, a forward portion of side panel 24 and flange 81. This channel forms a housing for elongate light assembly 100 and places it out of the normal view of persons inspecting the products on display. The light assembly 100 in this forward and vertical position provides an improved pleasing and balanced lighting output upon the interior of the alcove-like display structure, particularly compared to the types of overhead lighting featured in the prior art. Further, an overhead cornice and lighting arrangement is not required to provide lighting employing a lighting arrangement according to the embodiment shown in FIG. 1, although the basic structure of display unit 20 allows one to use an overhead or other alternative lighting arrangement if it is deemed desirable for a particular display application.

Upon completing the assembly of the components comprising the embodiment shown in FIG. 1, it should be noted that a user may mount accessories, such as samples of interior cloth decoration used in the caskets displayed or other death care accessories, upon the bottom 88 of the vertically disposed drawer 84. Pulling upon handle 96 to extend drawer 84, one may conveniently view such accessories as desired and then push handle 96 inwardly to slidable return drawer 84 to its retracted position.

Now referring to FIGS. 10–16, another preferred embodiment of the present invention is illustrated. Those portions or components that are identical to the portions or components shown and described in connection with the embodiment illustrated in FIG. 1 will be identified by the same reference numerals as priorly used. For purposes of brevity, those components of the embodiment illustrated in FIGS. 10–16 which are identical and are identified by the same reference numerals as used in describing FIGS. 1–9 may be described generally by reference to the description of the embodiment illustrated in FIG. 1 to reduce repetition unnecessary to describe the invention within the understanding of one of ordinary skill in the art.

Figure 10:
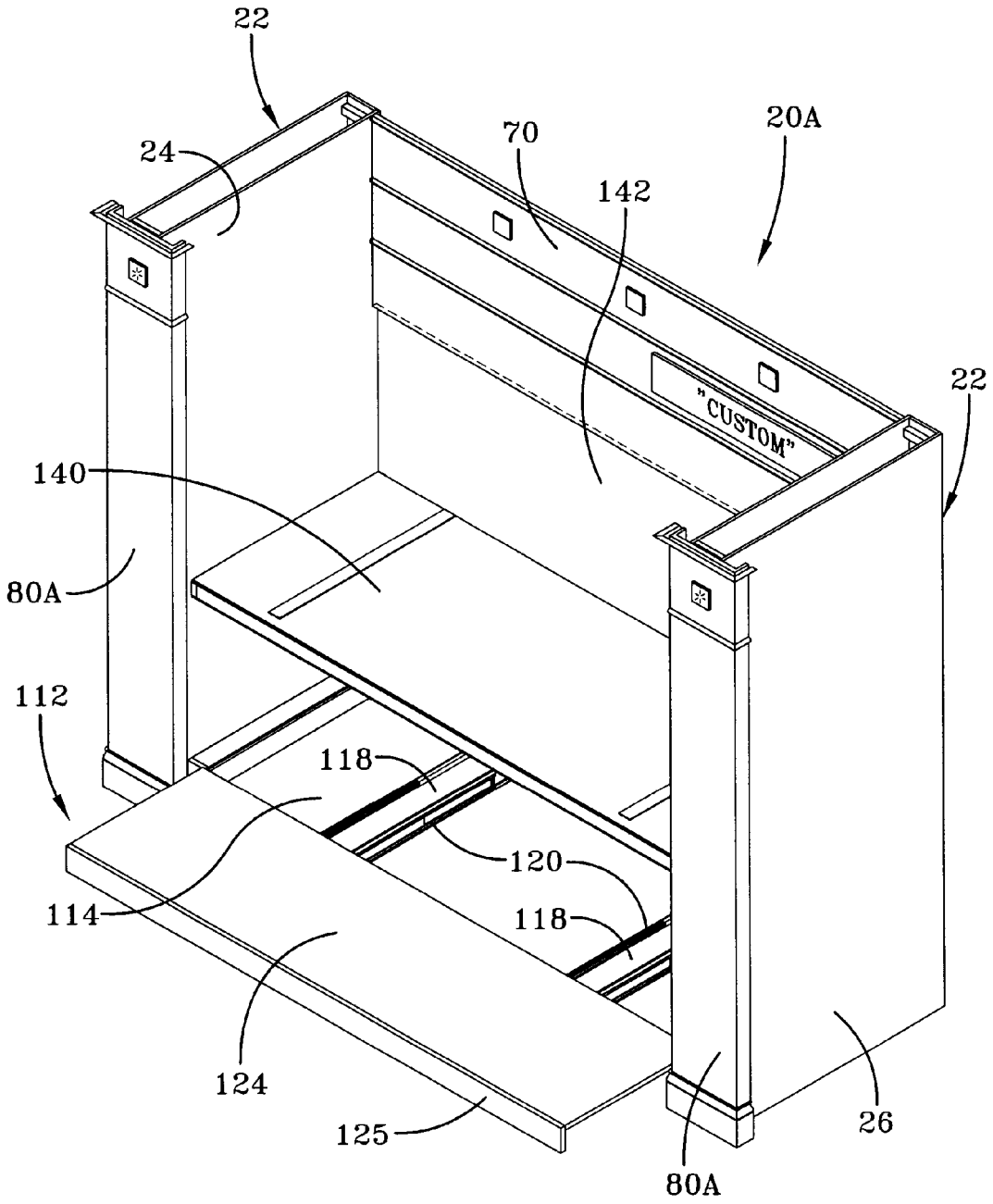
FIG. 10 is a perspective view of another preferred embodiment of the present invention illustrating a plural full casket display unit provided with an upper shelf and a slidable mounted pull out lower shelf.

The display unit 20-A shown in FIG. 10 is similar to the embodiment shown in FIG. 1, except a pull-out type lower shelf assembly and a stationary upper shelf are provided preferably for displaying a pair of full size caskets. The slidably mounted display panel 84 is optional but omitted in the unit shown.

The display unit 20-A shown in FIGS. 10–16 comprises a pair of free-standing side wall members 22 essentially constructed identical to the side wall members 22 shown and described in connection with the embodiment of FIG. 1.

Each side wall member 22 includes the same components such as spaced, side panels 24 and 26, interior brace members 30, bottom panel 42, vertical panels 34 and 36, cross member 43 and foot 46 and threaded levelers 48.

Additionally, each inwardly facing side panel 24 of the spaced side walls 22 include vertically spaced angle supports 50 mounted in aligned relationship as previously described.

Figure 11:
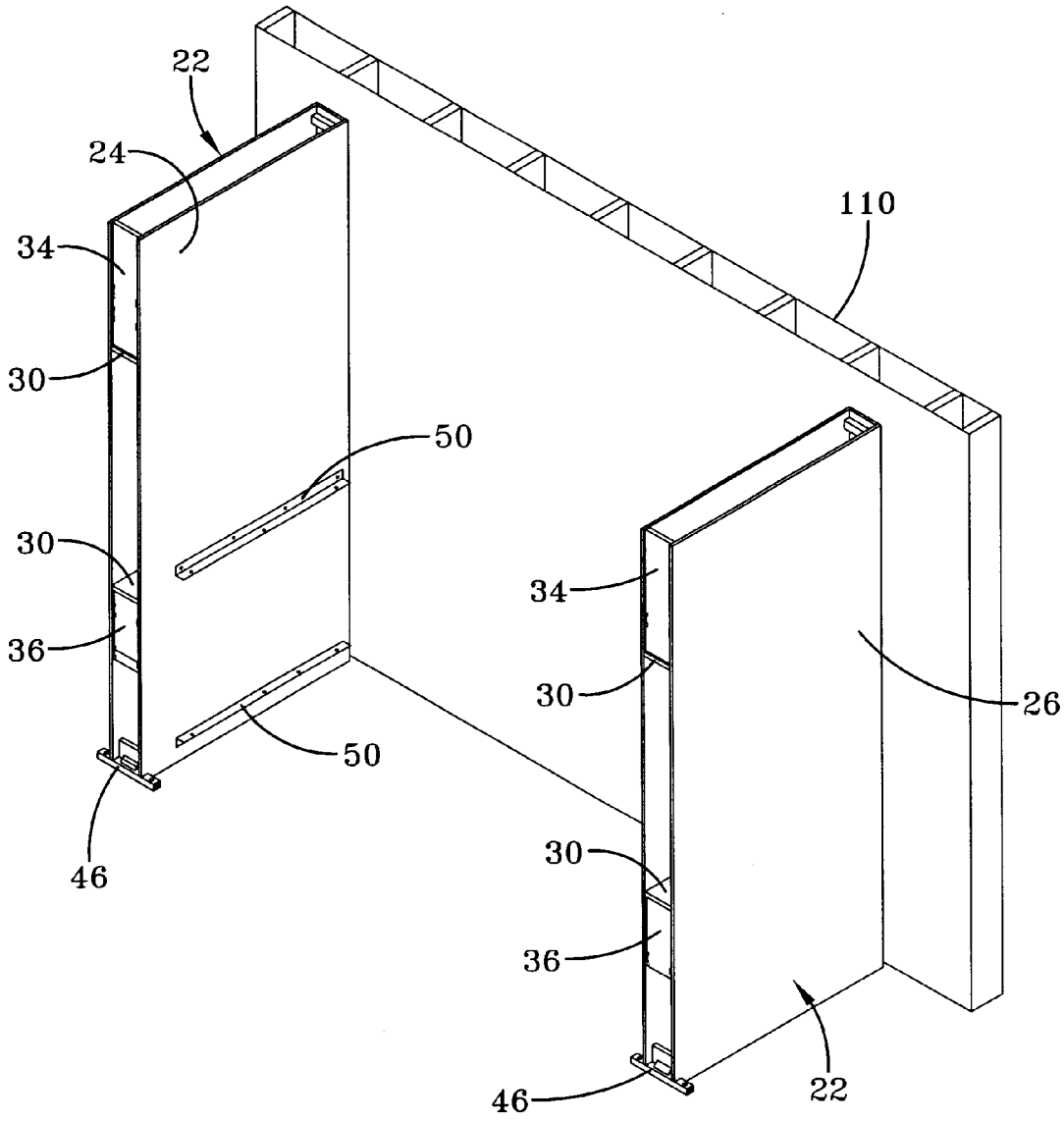
FIG. 11 is a partial perspective view of a portion of the unit shown in FIG. 10 illustrating the arrangement of a pair of side walls relative to one another prior to mounting the shelves to the unit.
Figure 12:
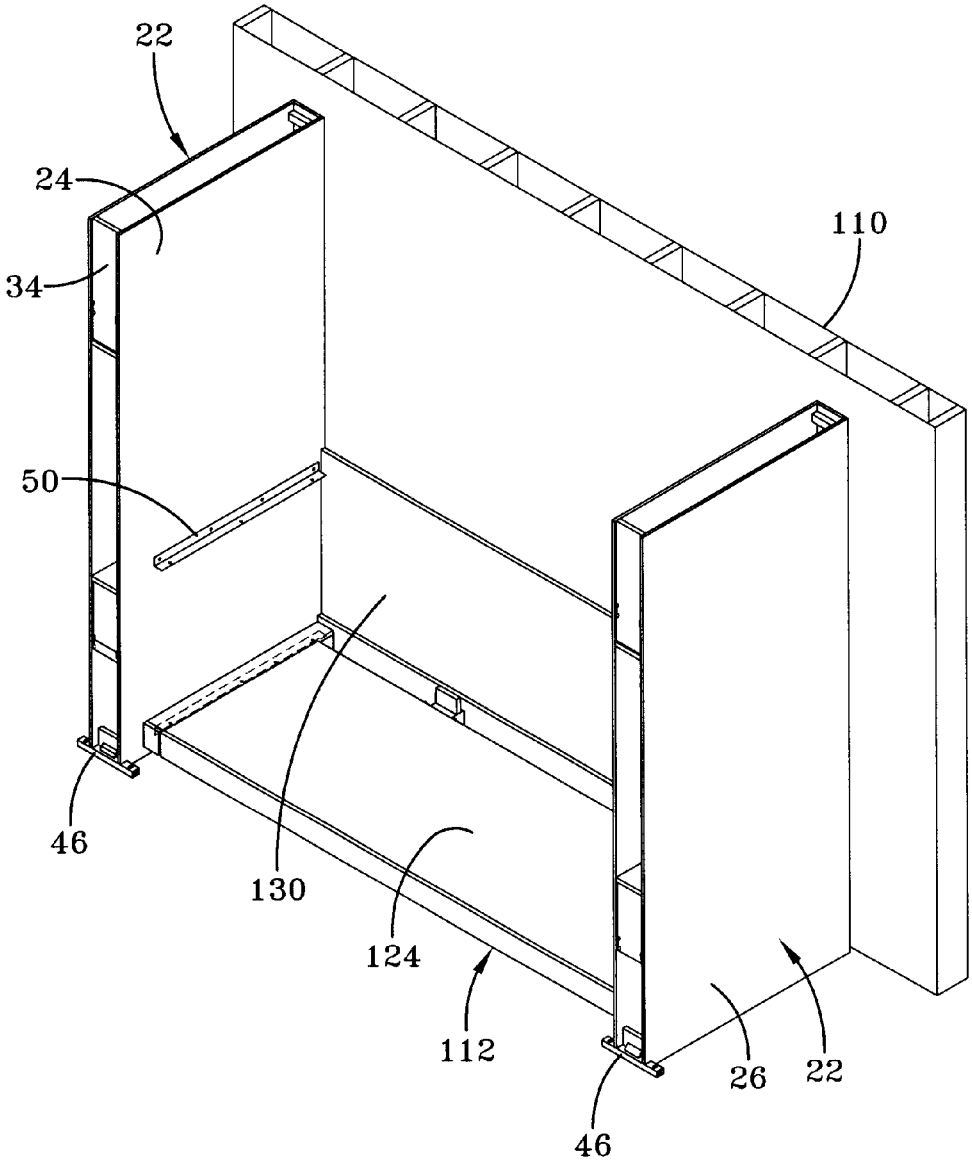
FIG. 12 is a partial perspective view of the display unit shown in FIG. 10 illustrating the base and slidable shelf assembly forming part of the display unit shown in FIG. 10 in its mounted condition.
Figure 13:
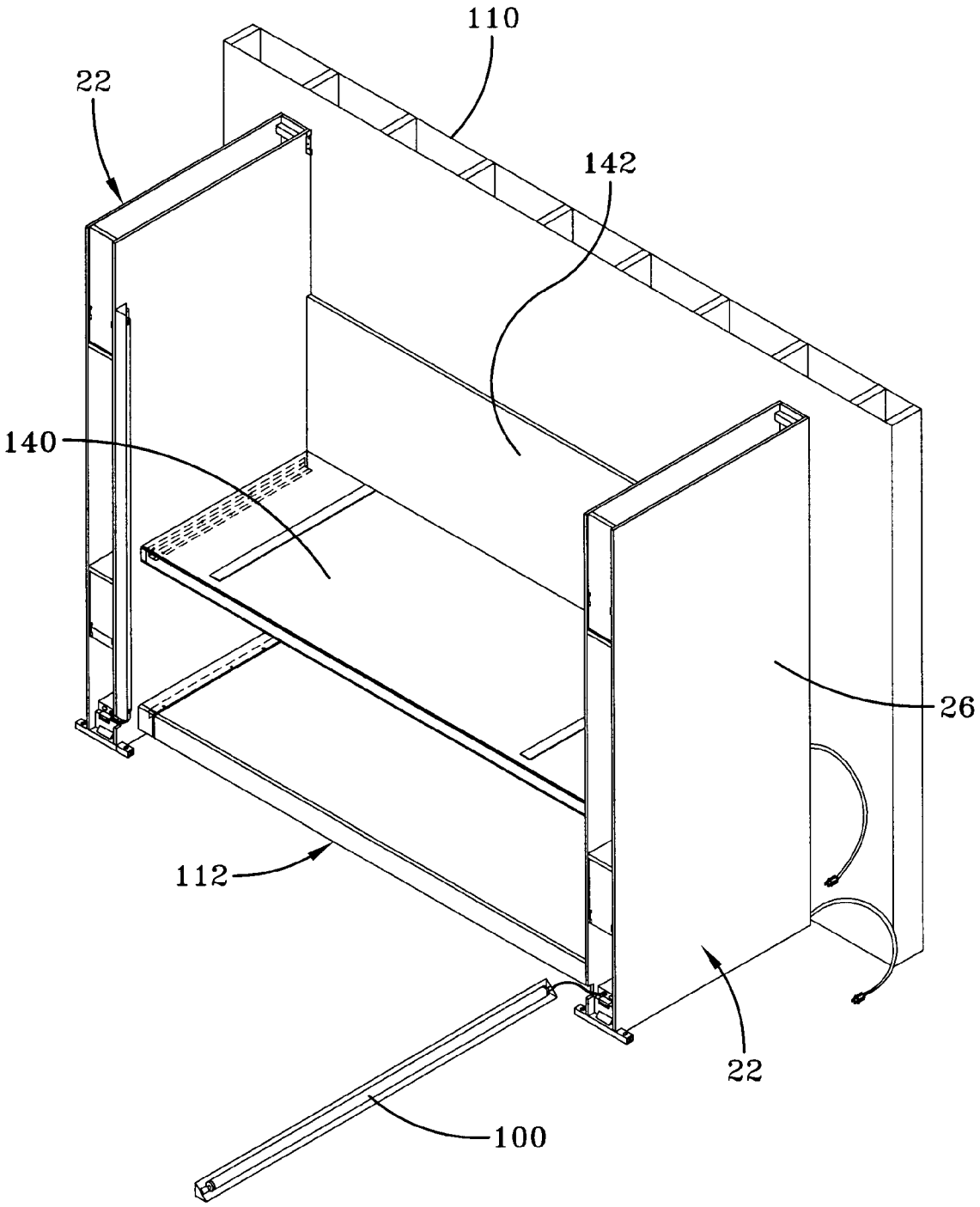
FIG. 13 is a partial perspective view similar to FIG. 11 illustrating the unit with the upper shelf installed and showing a lighting assembly for the display unit shown in FIG. 10.

As shown in FIG. 11, a wall 110 of a display room is diagrammatically illustrated to illustrate one form of the embodiment wherein the wall 110 may effectively form the rear wall panel to form an alcove type configuration in cooperation with the free standing side walls 22, if desired. A rear wall panel's primary function is to form an attractive background for display purposes in accordance with the present invention in connection with the embodiments shown in FIGS. 1 and 10, since side wall members 22 stand vertically independent of the rear wall panel. However, in most commercial environments, it is deemed desirable to provide a particularly attractive background rather than rely upon the background provided by the wall of the display room in which the display unit(s) are employed. This is particularly applicable in those instances wherein the display unit is disposed a significant distance from a wall of the display room. It should be pointed out that it is not necessary to provide stability or strength to the display unit 20 or 20-A or either side wall members 22 by attaching the same to the room wall 110 for purposes of the present invention. For example, display unit 20 or 20-A may be disposed toward the middle of such a room, well away from room walls such as 110.

As shown in FIGS. 10–16, each side wall 22 is disposed with the rearward edges thereof closely adjacent, but unattached to, wall 110 Approximately 1 to 2 inches of space is deemed appropriate when the display unit 20 is disposed close to a wall, such as 110 of the display room.

The lower pull-out or retractable shelf assembly 112 is mounted to the opposing, horizontally aligned angle supports 50 in essentially the same manner as previously described with regard to shelf 60 of the embodiment of FIG. 1. That is, spaced dowels, not shown, are fixedly provided on the bottom surface of shelf assembly 112. The dowels are adapted for insertion in mating holes provided in angle supports 50. For added secure engagement, one or more conventional threaded fasteners, such as a thumb screw for example, may be employed via a through hole provided in the top surface of base 114 of shelf assembly 112 and through an appropriate aligned hole, not shown, provided in angle support 50.

Figure 14:
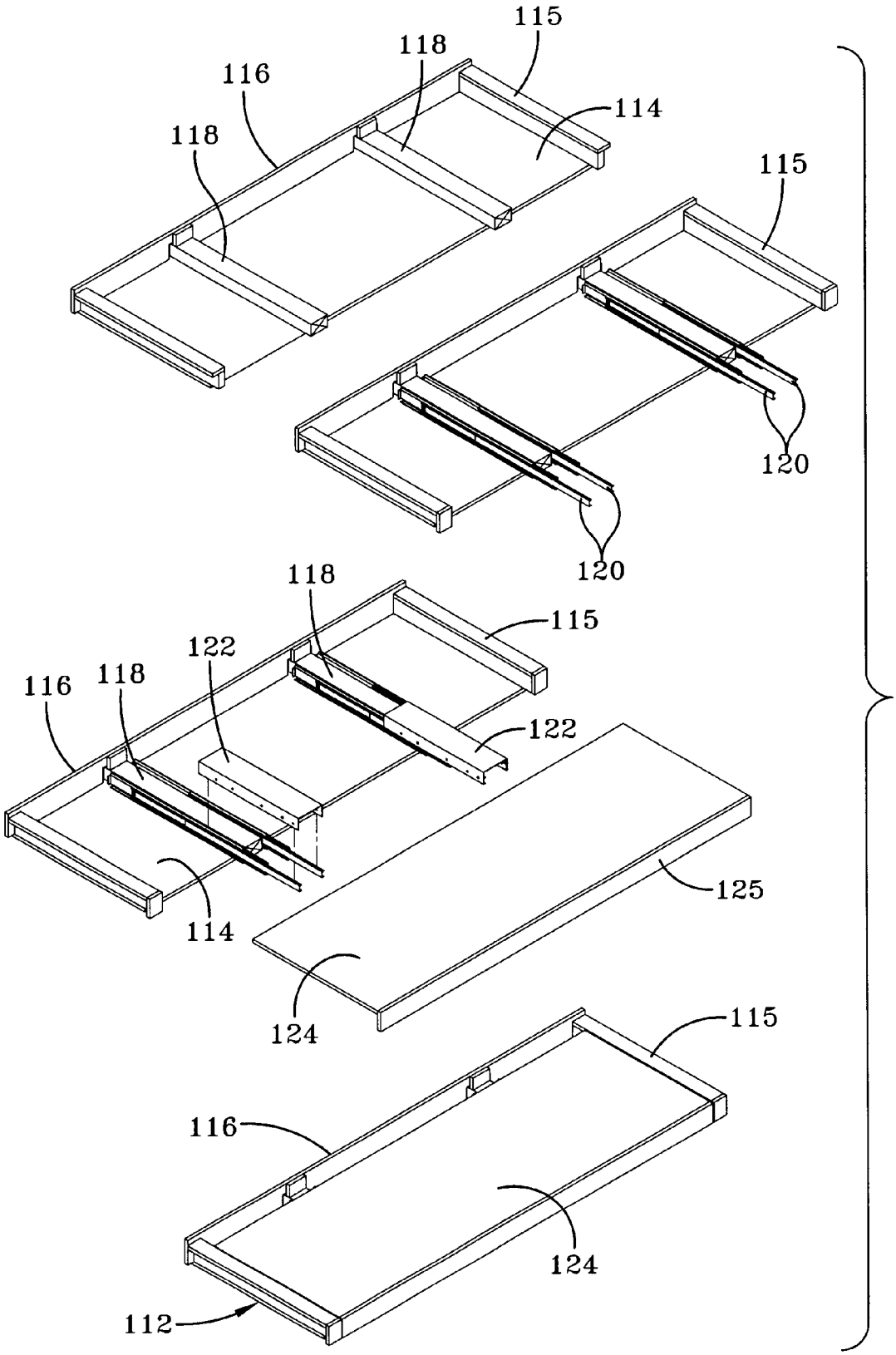
FIG. 14 is an exploded view illustrating the construction of the base and slidable shelf assembly apart from the remaining structure of the display unit shown in FIG. 10.

As best seen in FIG. 14, shelf assembly 112 comprises a base or platform 114 provided with side walls 115 and a rear wall 116. A pair of elongate, rectangularly shaped guide members 118 may be conventionally fixed to the upper surface of base 114 and to the rear wall 116 in spaced relationship to one another as shown in FIG. 14. A conventional heavy duty metal drawer track comprising a set of rails 120 is fixed to a respective one of guide members 118 and receives a U-shaped slide member 122 slidably mounted within rails 120 between predetermined retracted and extended portions. A shelf member 124 is fixed in any suitable conventional manner to the top of each slide member 122 such that shelf member 124 may be slidable moved between a fully retracted position virtually overlying base 114 and an extended position, such as shown in FIG. 10. Shelf member 124 is provided with a front lip 125 which conceals portions of the slide assembly from view in the fully retracted position. Shelf assembly 112 may be efficiently assembled in the factory and shipped as a single component along with the other component parts for assembly as described herein within the chosen display room of a funeral home.

Other equivalent conventional means for slidably mounting shelf member over the underlying base 114 may be employed to obtain retractable movement of shelf member 124 as shown and maintain member 124 supported above the floor surface upon which side wall members 22 rest in a simple, easily constructed and efficient manner.

Figure 15A:
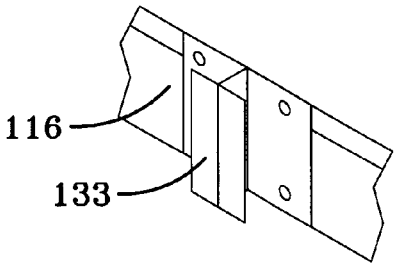
FIG. 15 is an exploded view showing the slidable shelf assembly and a rear panel mountable thereto in isolation from the remaining structure of the unit shown in FIG. 10.
Figure 15B:
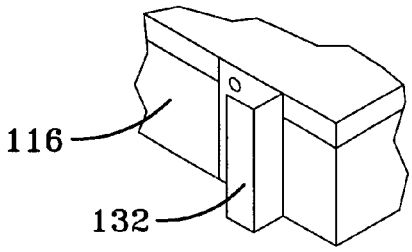
Figure 15:
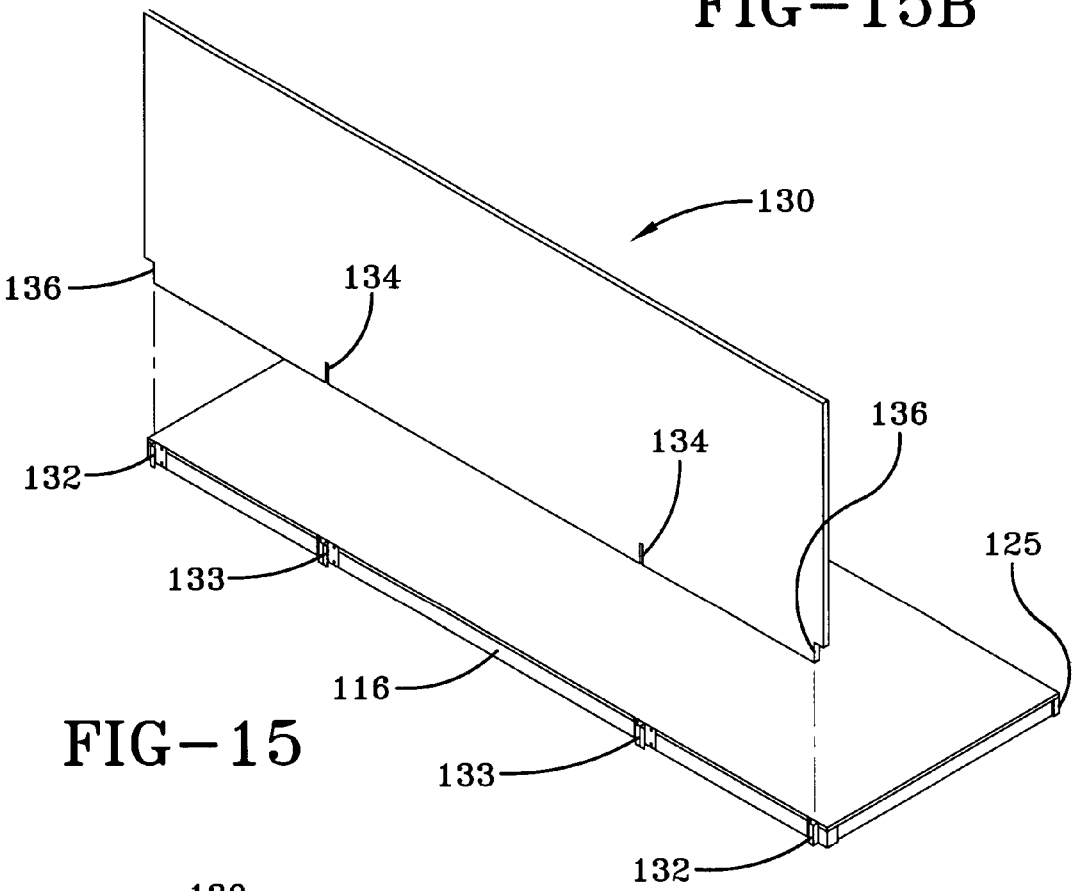
Figure 15C:
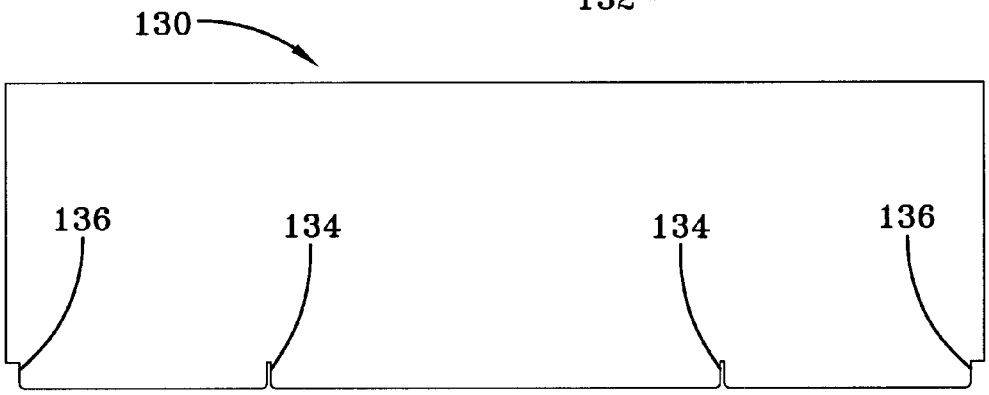

Once shelf assembly 112 is mounted as described, preferably a back panel 130 is mounted to the rear wall 116 of base 114 by means of a plurality conventional J-type clips, such as at 132 and 133, spaced along the rear wall 116. Such clips are adapted to engage notches 134 or L-shaped grooves 136 such as shown in FIGS. 15–15C in a manner well-known in the art to support panel 130 in a vertical position.

A stationary upper shelf 140 may be added to this embodiment and is removably mounted to the opposing upper aligned pair of angle supports 50 in the same manner as previously described for base 114 or shelves 60 of FIG. 1.

Similarly, a back or rear middle panel 142 may be removably fixed to shelf 140 using J clips and the notch and L-shaped slot construction described relative to back panel 130 and the rear of shelf assembly 112. Preferably shelf 140 is made more sturdy in any conventional, suitable manner, such as adding cross braces or the like to the underneath surface to assure it will safely bear the weight of a full size casket or other similar product.

Figure 16:
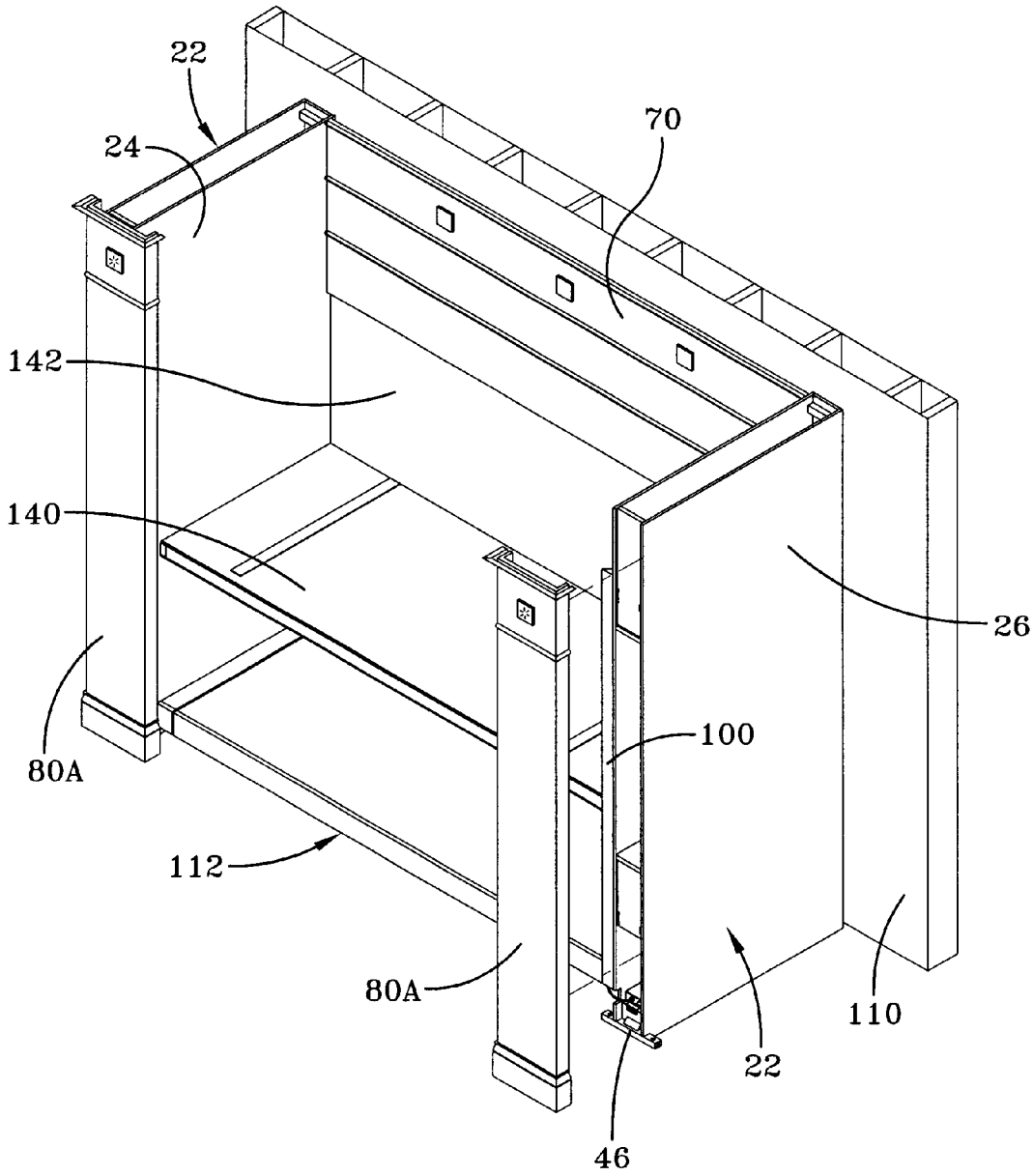
FIG. 16 is a perspective view of the unit shown in FIG. 10 illustrating the mounting of the removable front covers to the side walls.

As best seen in FIG. 16, a lighting assembly 100 identical in construction to that used in the embodiment of FIG. 1 may be similarly mounted and included in the embodiment of FIGS. 10–16. Further a front cover 80-A, which is identical in all respects to front cover 80, except for the lack of an opening, such as 82, is removably mounted to side wall members 22 in the same manner as previously described with respect to covers 80.

While display panel 84 may be optionally included if deemed desirable, typically there is less need to display accessories related to casket interior decor in full size displays since the interior of a full casket display allows opening of the top of the casket to view the interior decor.

The lower pull-out shelf assembly 112 permits the casket top to be opened for display purposes upon moving shelf member 124 to the extended position.

Figure 18:
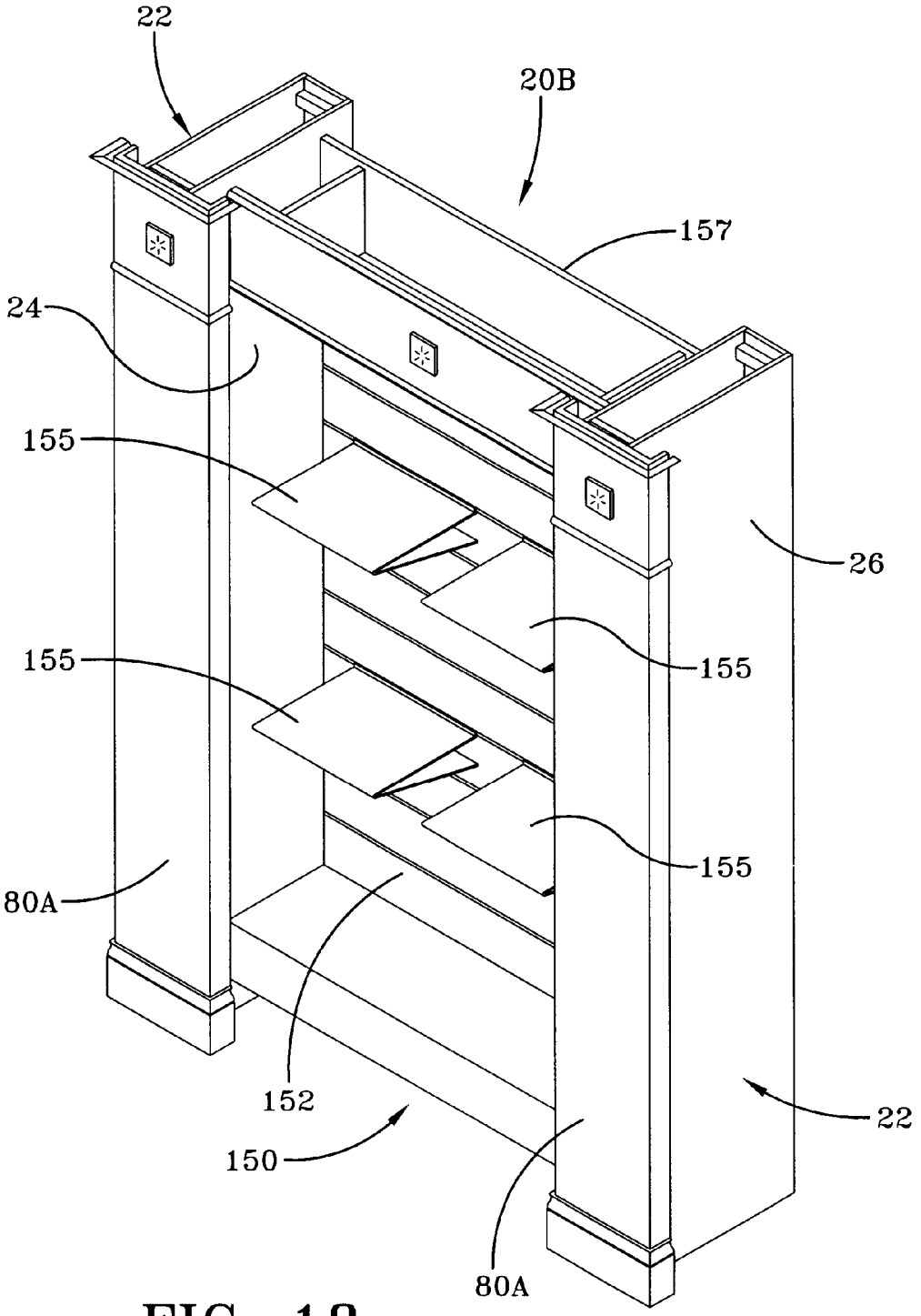
FIG. 18 is a perspective view of another embodiment of the present invention illustrating a "slat wall" rear panel and suitable shelves for displaying miniature vaults or other death care products.

Another preferred embodiment of the present invention is illustrated in FIG. 18 wherein a display unit 20-B comprises side wall members 22 of virtually identical construction to side wall members 22 of the embodiment described in FIG. 10 and include the major components such as, for example, side panels 24, 26, rear panel 28, bottom panel 42, foot 46, the brace members 30, forward panels 34 and 36 and front cover 80-A. Preferably the elongate vertically disposed lighting assembly 100 is also provided in the embodiment of FIG. 18 in the same manner as previously described herein. In addition, an opposing pair of angle supports 50 are employed to mount a base or deck 150. Deck 150 may comprise a sturdy box like construction, such as seen in FIGS. 18–28, or may be any equivalent form to provide appropriate support in an aesthetically pleasing fashion for a rear wall panel 152 as shown in FIGS. 18–27.

Rear panel 152 includes a plurality of horizontal, vertical spaced recessed grooves, such as at 154, and is sometimes referred to as a "slat wall" in the trade. Panel 152 is adapted to receive various shelf-type items for displaying products, including one typical well-known form, such a V-shaped shelf 155. The uppermost rear edge of shelf 155 may include an upturned lip adapted to be received in a recessed groove 154 with the lower rear edge of the V-configuration disposed in engagement with the next lower groove to effectively removably lock shelf 155 in a position on rear panel 152 capable of supporting a given load. Other forms of shelf devices may also be advantageously used and mounted to such a "slat wall" construction in a manner well-known to those skilled in the art.

Figure 19:
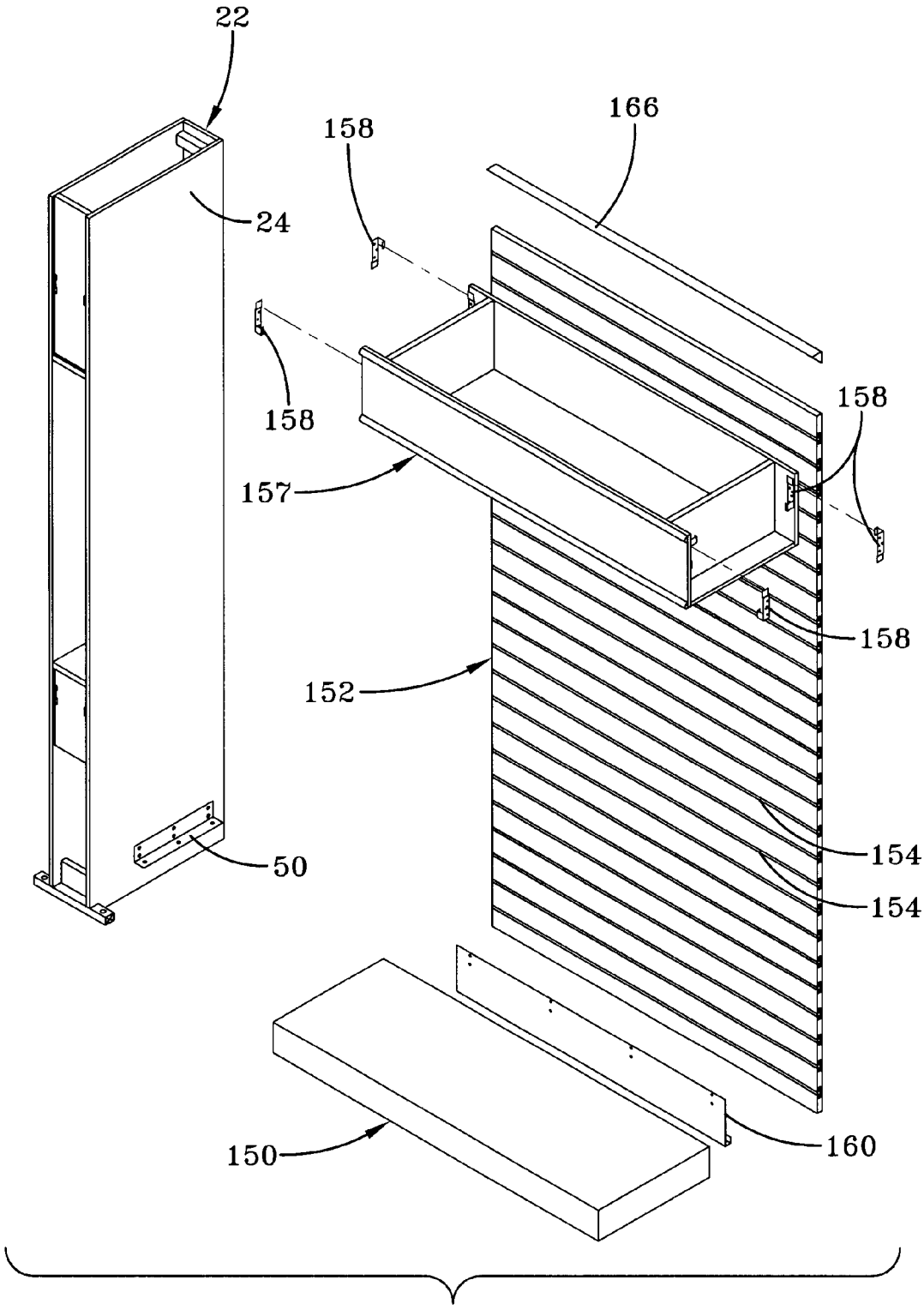
FIG. 19 is a perspective exploded view of a portion of the unit shown in FIG. 18 illustrating the mounting relationship between some of the components forming the unit shown in FIG. 18.

Preferably, the embodiment of FIG. 18 includes a cornice assembly 157 which may be in a simple open top box configuration, such as seen in FIGS. 19–22. Cornice assembly 157 may be mounted between side walls 22 via any suitable, conventional fastening means, such as bed fitting components 158 conventionally attached in an aligned manner to cornice assembly 157 and one of the inner side panels 24, as illustrated in FIG. 19, in a similar manner as earlier described herein. The conventional bed fittings 158 are of the type which mate at an angle and are illustrated in FIG. 19-A, however, other forms of conventional fasteners may also be employed to obtain the attaching function.

Rear panel 152 is mounted between side wall members 22 via a conventional metal J-shaped channel 160 having its upper leg 162 conventionally fixed to the rear of deck 150 and its lower leg 164 resting upon the supporting floor surface of the display room, not illustrated.

Panel 152 may include spaced reinforcing U-shaped members 153 attached in any conventional manner to the rear surface to provide additional stiffness and strength as deemed suitable for a given application.

Figure 27:
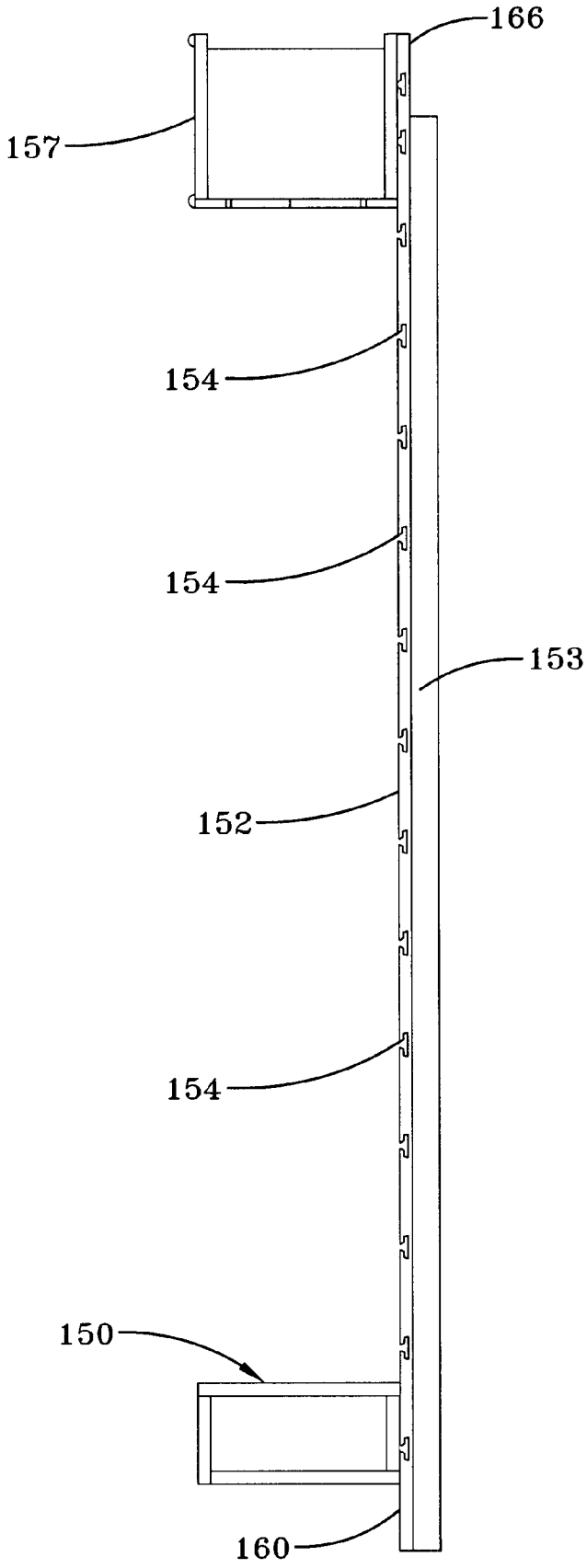
FIG. 27 is a partial side elevational view of the unit shown in FIG. 18 illustrating the arrangement between the rear panel, the cornice assembly and the deck portions.
Figure 28:
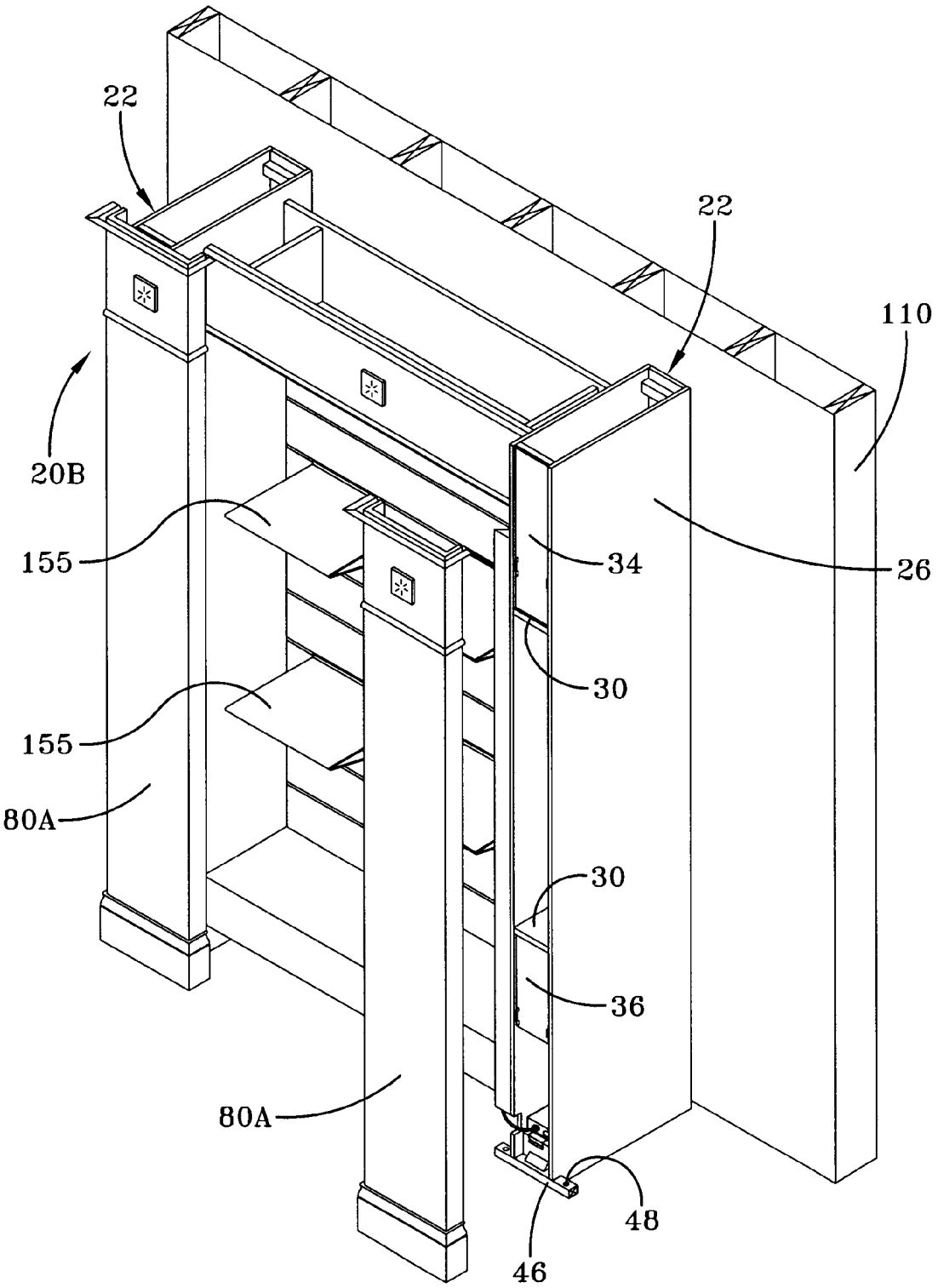
FIG. 28 is a perspective view of the unit shown in FIG. 18 illustrating the mounting relationship of the front cover to the side walls.

Rear panel 152 is installed in position by resting its lower end in J-channel 160 and capturing its upper end in a L-shaped channel 166, as best seen in FIGS. 19 and 27. L-channel 166 may be fixed to the rear wall of cornice assembly 157 in any conventional manner, such as via conventional threaded fasteners for example, not shown.

The embodiment shown in FIG. 18 is very suitable for displaying miniature death care products, such as miniature vaults and the like, disposed on the top portion of each shelf 155 in an efficient, aesthetically pleasing manner.

Now referring to FIGS. 29–33 a display unit 20-C is illustrated. Again those components identified by identical reference numerals are identical in construction as those previously described in connection with the embodiments in the preceding figures. Those components that very closely correspond to similar components previously described may be identified by the same reference numeral followed by the letter A.

The embodiment shown in FIGS. 29–33 is essentially identical in construction to the embodiment of FIG. 18 except for the types of shelving employed and accordingly having a rear panel without recessed grooves such as 154 shown in FIG. 18. The free-standing side wall members 22 are identical to those described with regard to embodiment of FIG. 18 and therefore a detailed description thereof is deemed unnecessary to understand the present invention.

Figure 30:
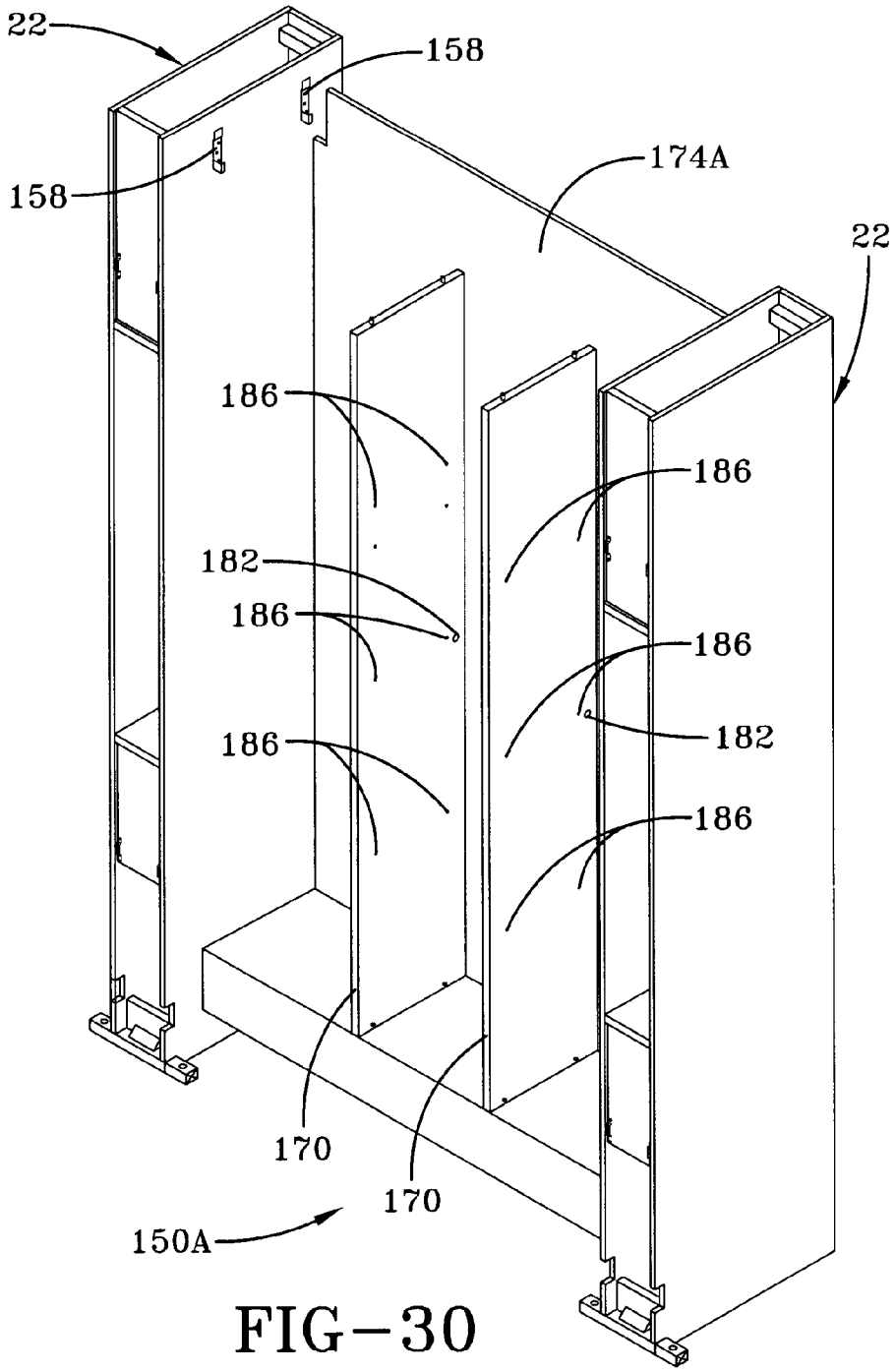
FIG. 30 is a partial perspective view of the display unit shown in FIG. 29 illustrating partial assembly of component portions without the cornice assembly, vertical dividers and shelving.
Figure 31:
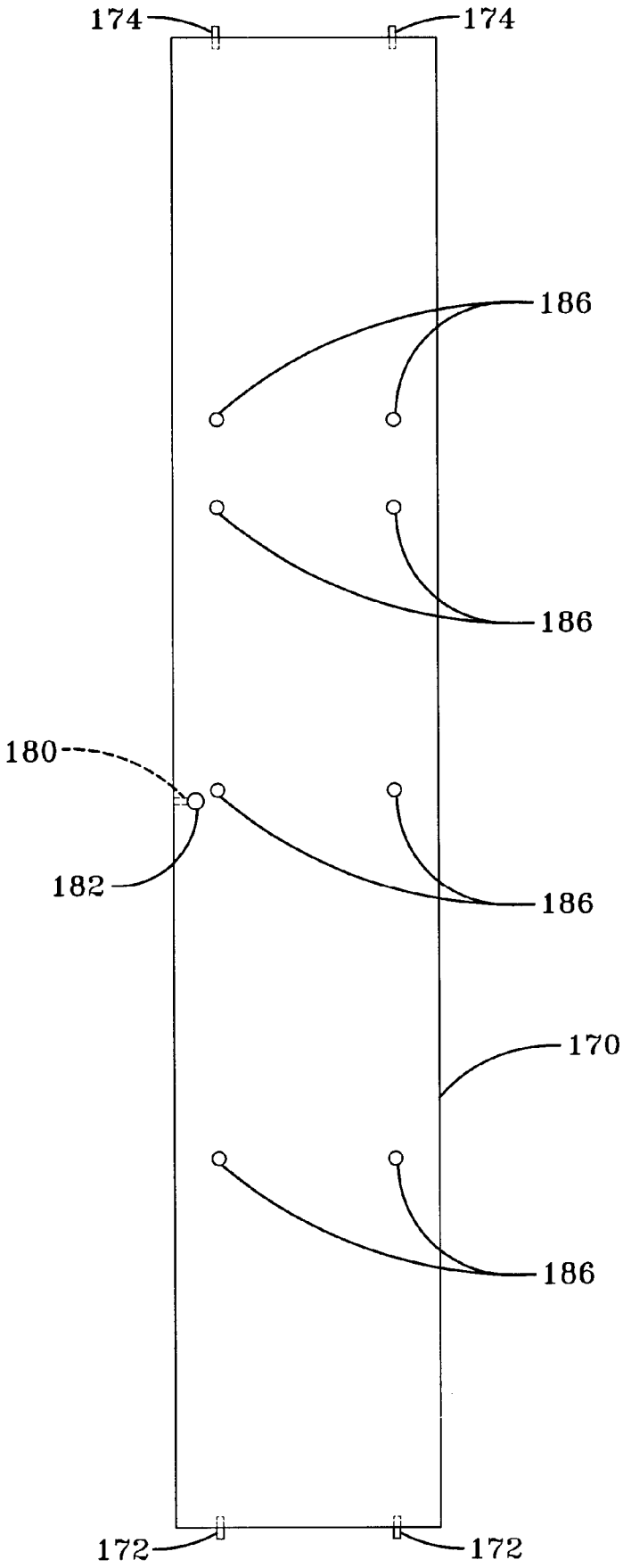
FIG. 31 is an isolated perspective view of a divider panel forming a part of the unit shown in FIG. 29.

The base or deck 150-A may be of identical construction to deck 150 shown in FIGS. 18–28 except for the provision of aligned drilled holes in the upper surface thereof adapted to accept dowels 172 extending from the lower edge of divider panels 170, best seen in FIGS. 30 and 31.

Divider panels 170 are also supported in a vertical attitude by outwardly extending dowels 172, which are adapted to be received in aligned holes provided in the bottom surface of a cornice 157-A assembly, not shown. In all other essential respect cornice assembly 157-A is constructed identically to cornice assembly 157 described earlier herein and may be mounted to side wall members 22 in the same manner as cornice assembly 157 using bed fitting such as 158.

Figure 21:
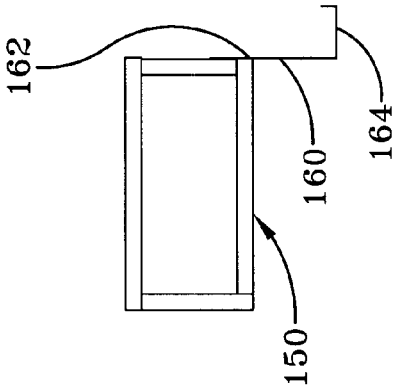
FIG. 21 is a side elevational view of the deck portion shown in FIG. 20 illustrating a J-type angle or metal channel used in the unit of FIG. 10.
Figure 20:
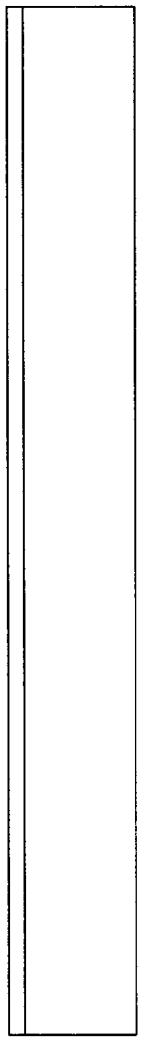
FIG. 20 is a front elevational view of the deck portion of the unit shown in FIG. 10 illustrated apart from the remaining structure.
Figure 22:
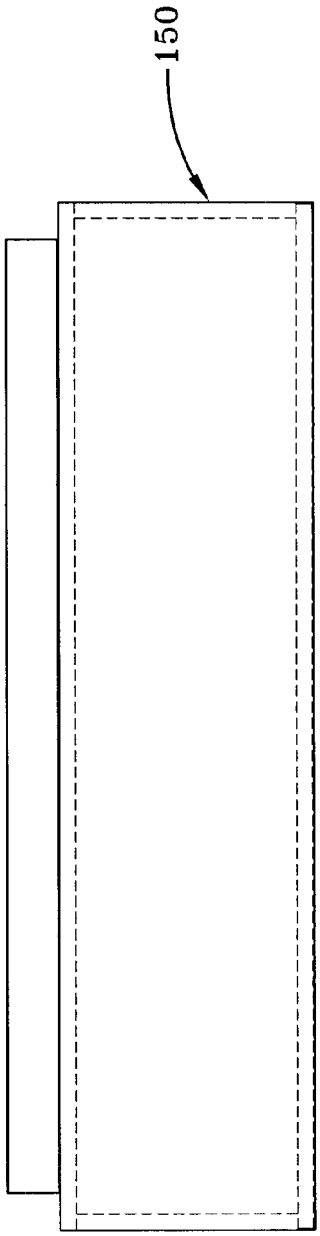
FIG. 22 is a top plan view of the deck portion shown in FIG. 21.
Figure 19A:
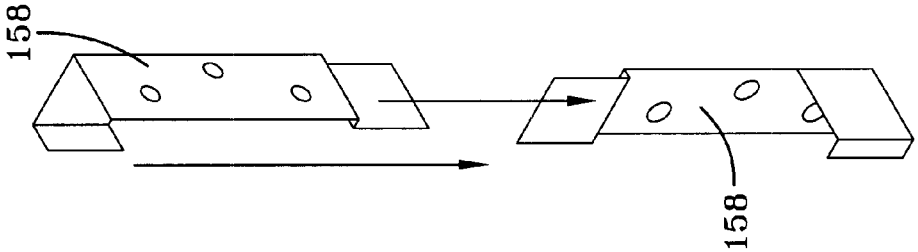
Figure 23:
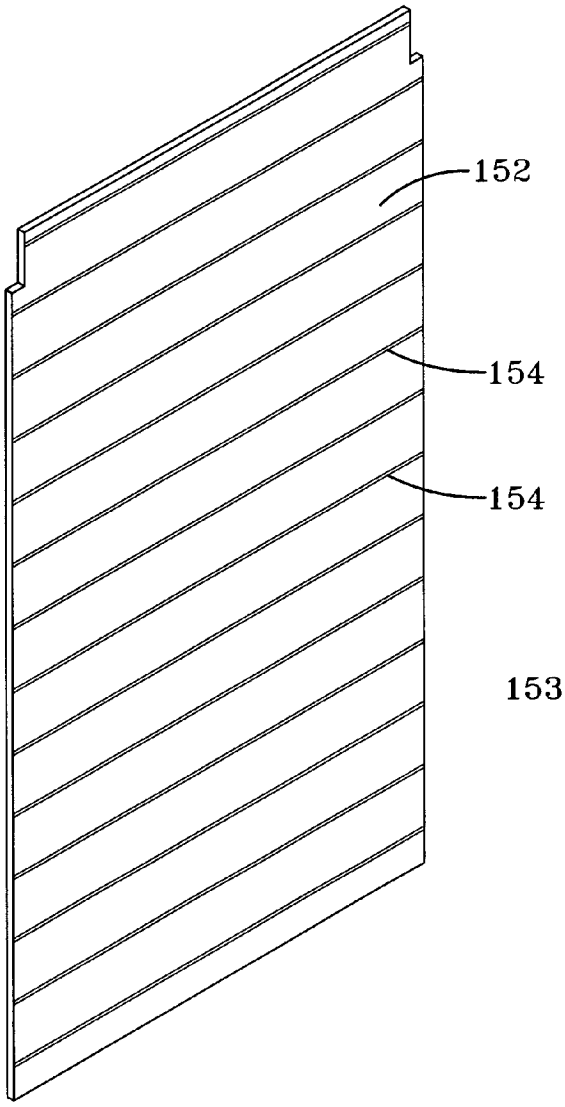
FIGS. 23 and 24 are isolated front and rear perspective views of the rear panel of the unit shown in FIG. 18.
Figure 24:
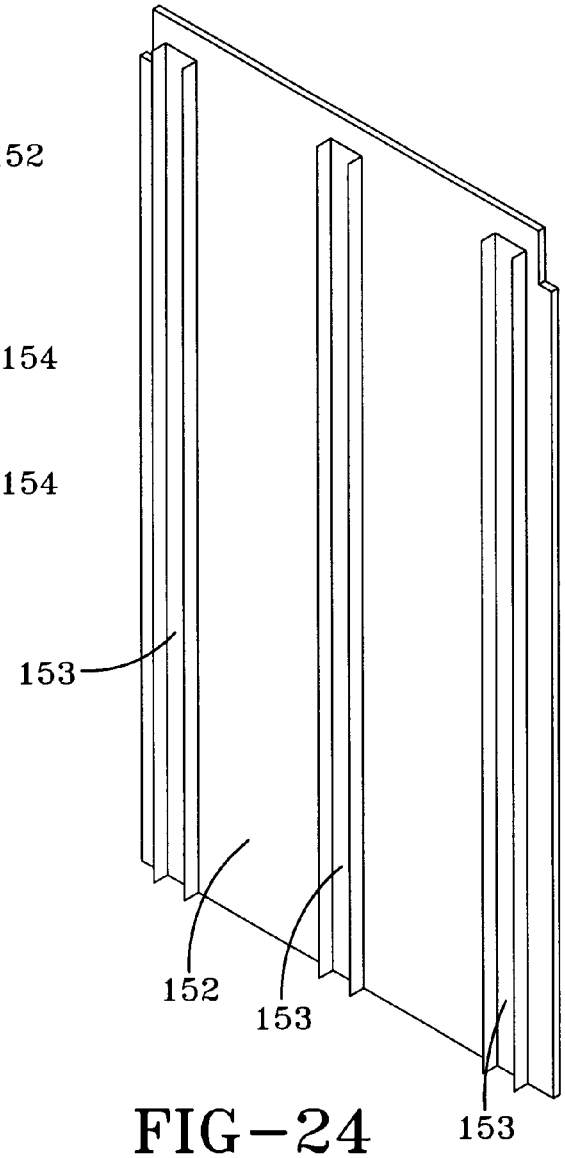
Figure 25:
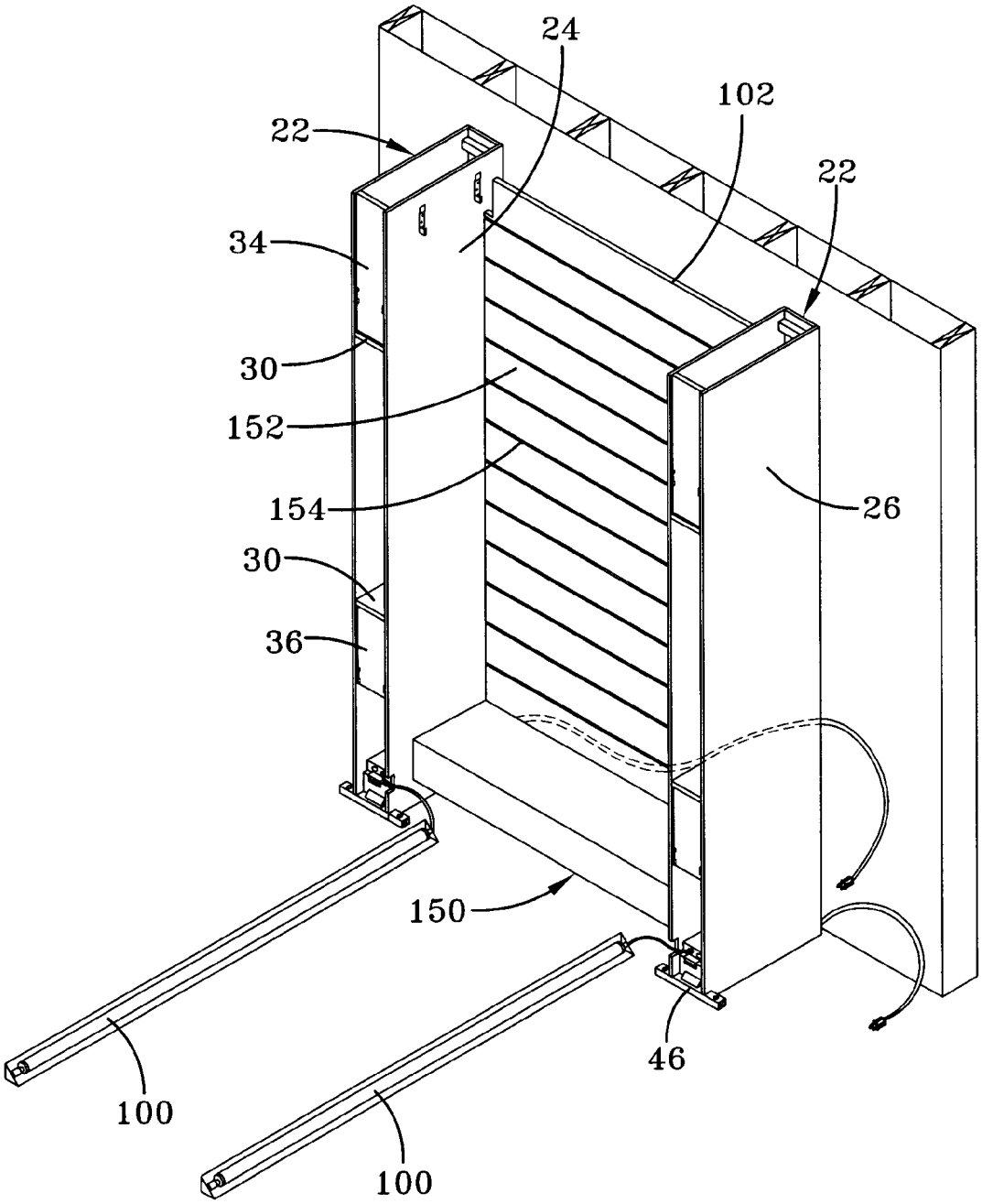
FIG. 25 is a partial perspective view of the unit shown in FIG. 18 illustrating the unit in partially assembled condition.
Figure 26:
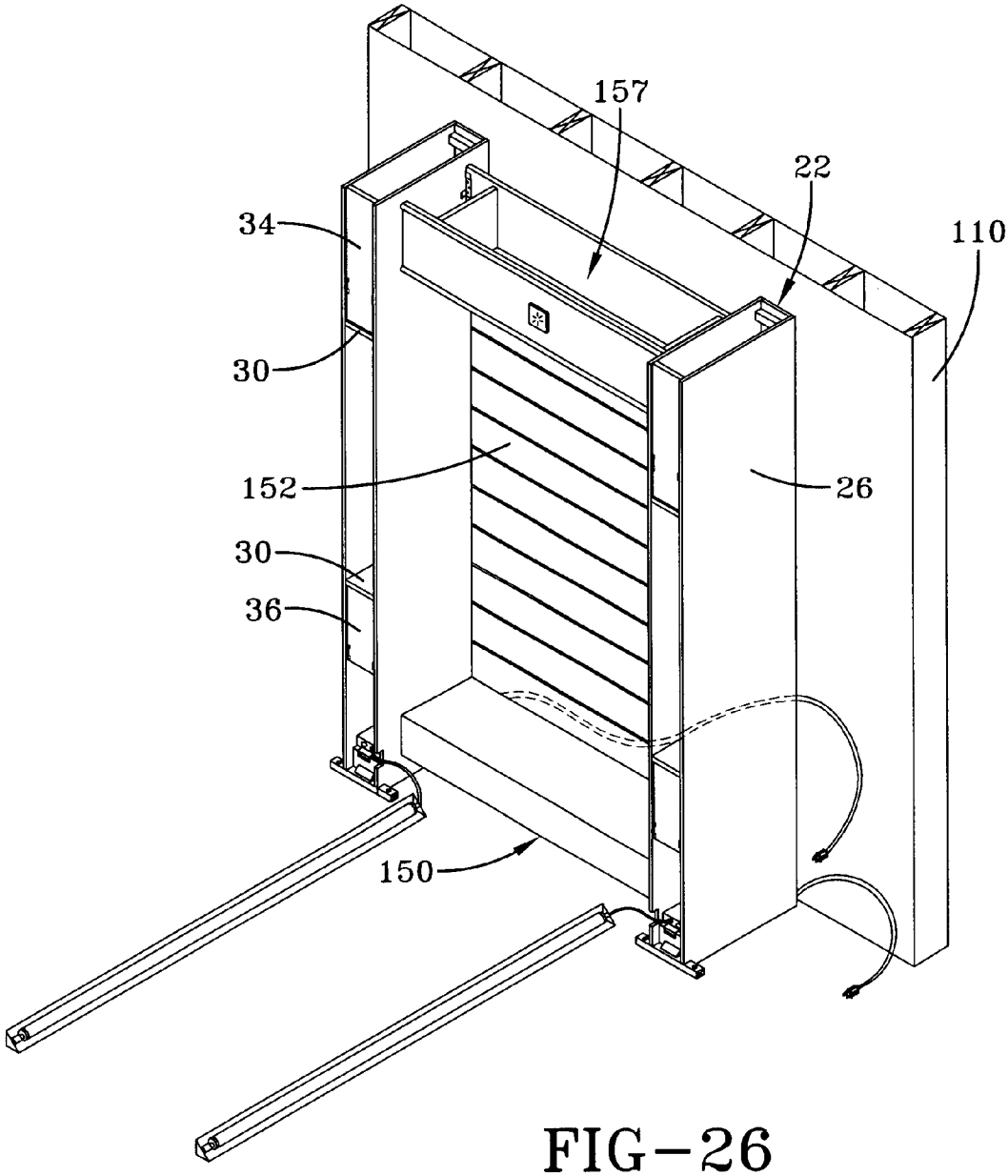
FIG. 26 is a partial perspective view similar to the view shown in FIG. 25 with a cornice assembly added thereto.

A rear panel 174-A is mounted between side walls 22 in a vertical attitude in essentially the same manner as rear panel 152 of the unit of FIG. 18 via a J-channel, similar to 160, and an L-shaped angle 166 such as shown in FIGS. 19 and 21. It should be noted, however, that if the death care items to be displayed are relatively lightweight, the J-channel used may be mounted to deck 150-A above the floor surface, instead of resting upon it as described in connection with the embodiment of FIG. 18.

In order to secure divider panels 170 in a more stable position, fastening means may be used which extend through rear panel 174 and into the rearwardly facing edge of divider panels 170.

Figure 30A:
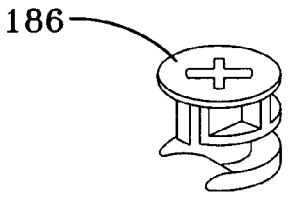
Figure 30B:
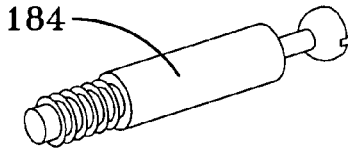

One convenient form of suitable fastening devices may be in the form of conventional and commercially available fasteners referred to as mini-fix fasteners, such as shown in FIGS. 30A and 30B.

As seen in FIG. 31, a hole 182 drilled through rear panel 170 is aligned with a hole 180 drilled into the rear edge of panel 157-A. Holes 180 and 182 intersect one another. The threaded portion of the male element 184 of the mini-fix fastener is extended through the hole 180 and into hole 182 and into engagement with the female element 186, which is positioned therein. Simply rotating the female element 186 relative to male element 184 locks the male element and female element together. Further rotation draws the male element 184 toward the female element to draw the rear panel and divider panels toward one another. One or more such fastening means may be used as deemed necessary for stability. It is preferred that the cornice assembly 157-A be installed as described after the mini-fix or other fastening devices used are secured between rear panel 174 and divider panels 170.

A plurality of horizontally aligned pairs of holes, such as 186, are drilled in each of divider panels 170 and each are adapted to receive conventional shelf pins, such as at 188, frictionally fit into the holes 186 in a manner well-known to those skilled in this art.

Then a shelf 190, preferably made of transparent material, such as glass or plastic, is mounted on each opposing pair of horizontally aligned shelf pins to support shelves 190 in a load bearing horizontal position.

This embodiment provides a very attractive display unit very well suited for displaying urns and the like in an efficient, yet highly aesthetic manner.

Figure 29:
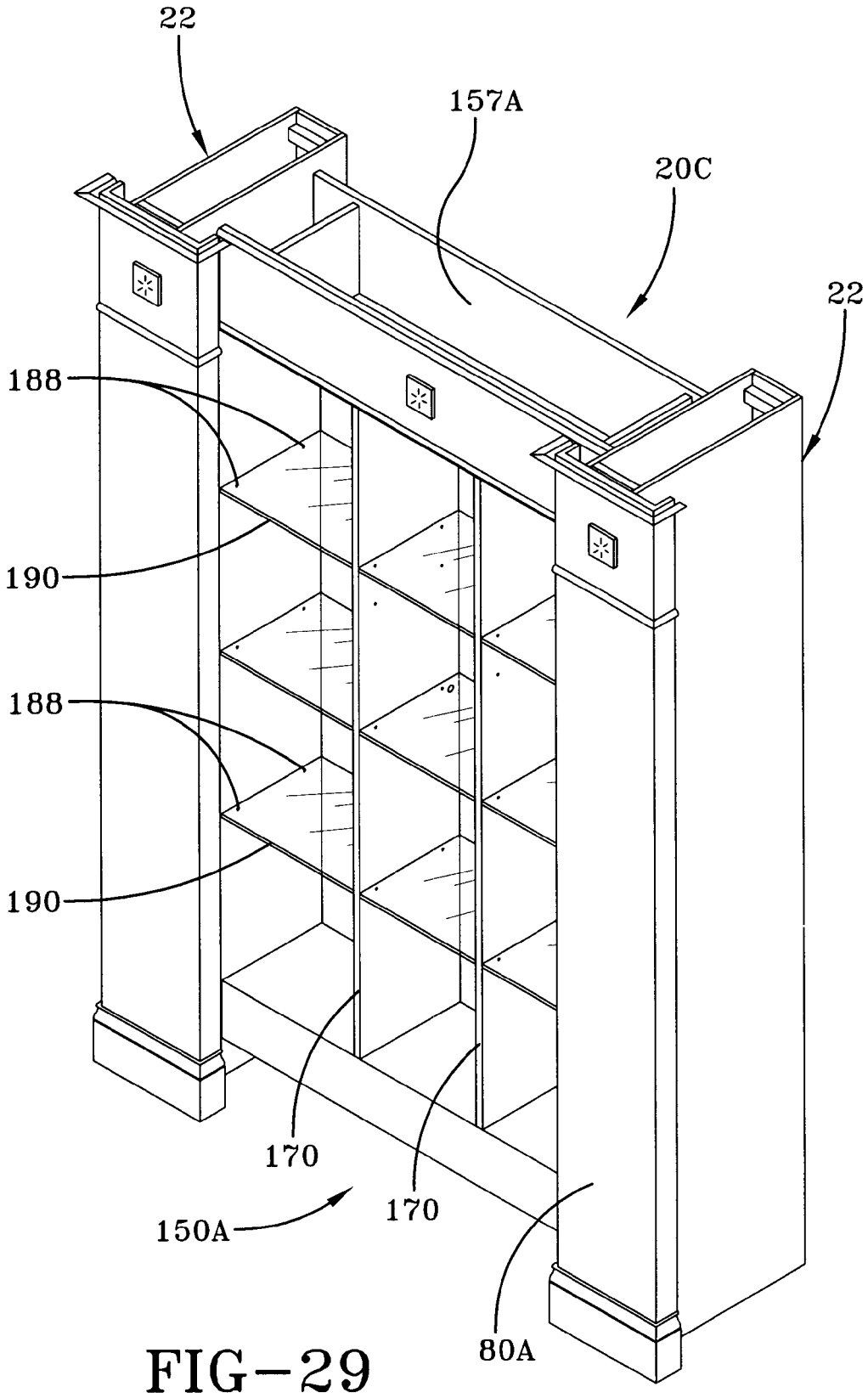
FIG. 29 is a perspective view of another preferred embodiment of the present invention illustrating a display unit adapted to display urns and/or other similar death products and accessories.

It should be noted that a vertical lighting assembly such as assembly 100 may be employed with the embodiment of FIG. 29 or an alternatively conventional lighting arrangement disposed in cornice assembly 157-A may be used. The latter employs suitable electric bulbs operably mounted in openings provided through the bottom surface of cornice assembly 157-A. Conventional electrical wiring and standard, commercially available components may be employed in a manner well-known in the art to provide electrical power to such an arrangement to install an overhead light source to the display unit 20-C.

Figure 32:
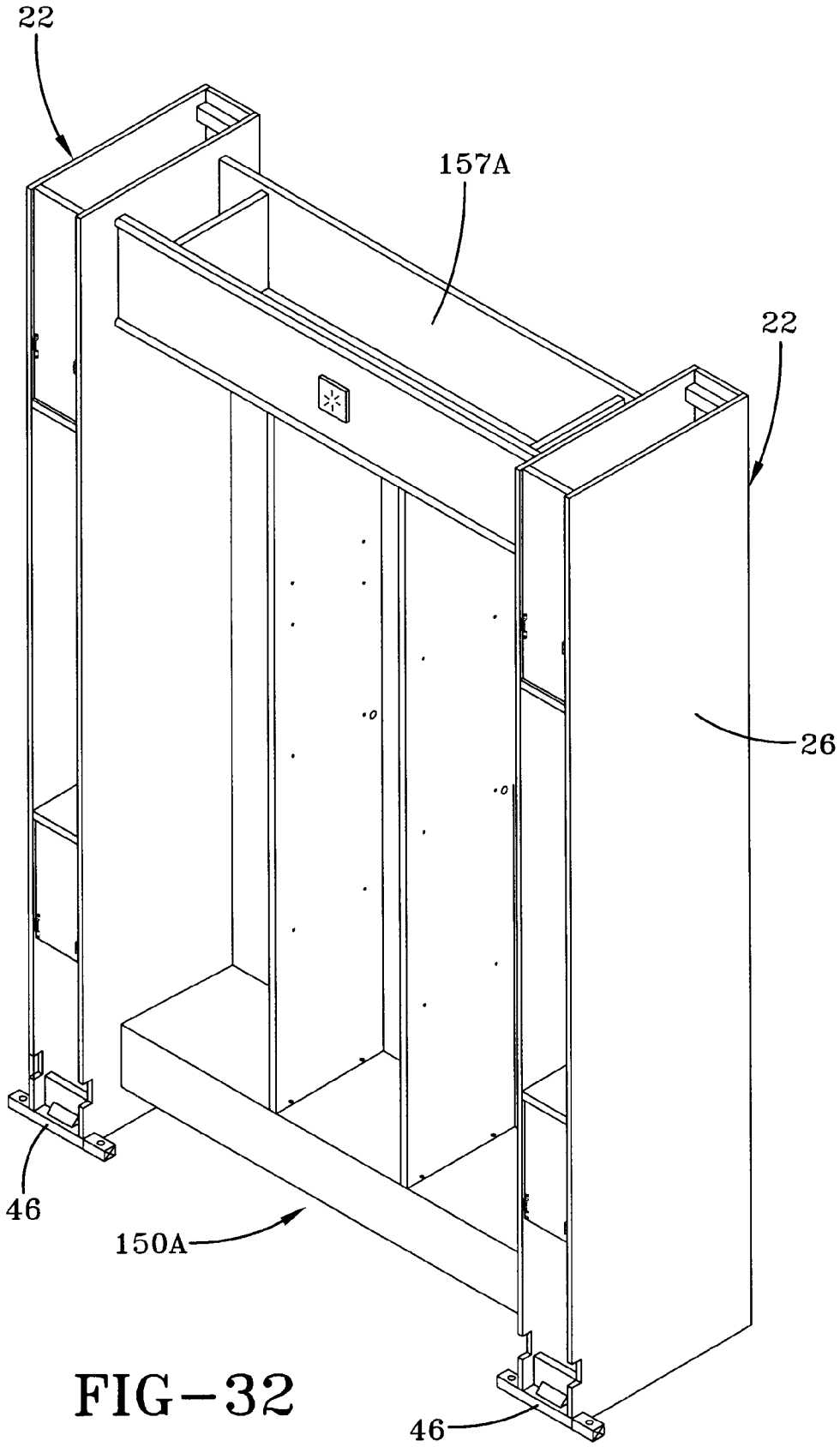
FIG. 32 is a partial perspective view of the display unit shown in FIG. 29 illustrating the further assembly including the vertical dividers and cornice assembly.
Figure 33:
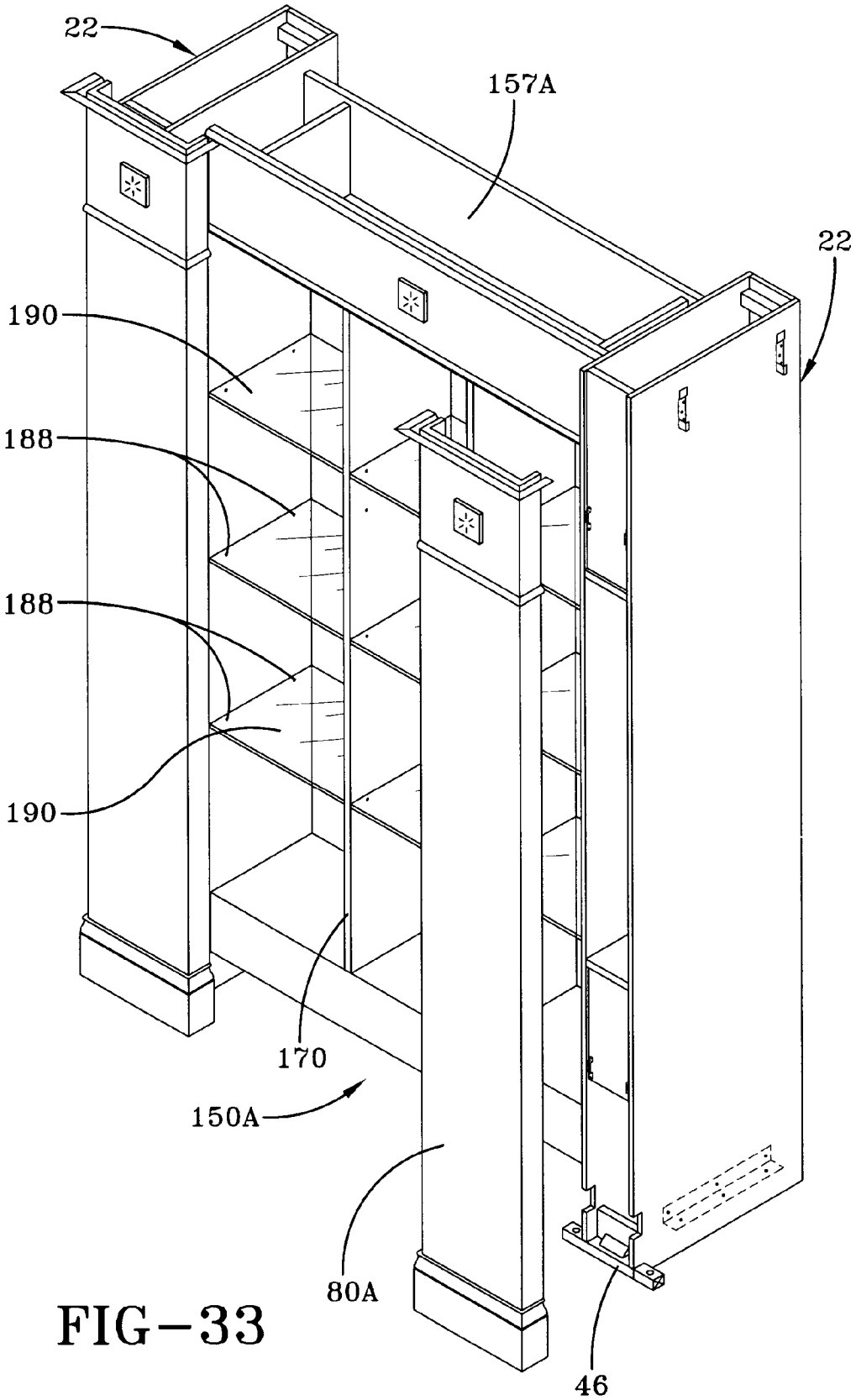
FIG. 33 is a perspective view of the unit shown in FIG. 29 illustrating the mounting of the front covers to the side walls.

FIGS. 32 and 33 illustrate unit 20-C after installation of the cornice assembly 157-A and the front covers 80-A. Each of these components may be mounted in the same manner as described with respect to the embodiment of FIG. 18.

In view of the foregoing description, it should be readily understood by one skilled in the art that a display unit constructed in accordance with the present invention provides a modular form of construction wherein the various components may be economically manufactured in a factory setting and delivered in a conventional manner for assembly at the final location in a relatively expeditious manner. The configuration using free-standing, laterally spaced side wall members, such as 22, provides a novel and efficient basis for a variety of display configurations having a strong, stable and easily assembled construction which also offers an improved aesthetic appearance deemed very desirable in the merchandising of death care products.

What is claimed is:

1. A death care product display unit comprising, in combination;

a) a pair of free standing vertical side wall members disposed in parallel spaced relationship relative to one another;

b) each of said side wall members comprising a pair of parallel, vertically extending side panels, connected to one another in laterally spaced relationship to define an interior chamber within each of said side walls;

c) a vertical rear wall extending between said side wall members to form a three-sided alcove configuration;

d) a pair of decorative panels, a respective one of said panels being attached to a frontal edge of a respective one of said side wall members to extend vertically over substantially the entire height of said frontal edge, each of said decorative panels having a width greater than the width of said frontal edge of said side wall members to present a simulated classical column frontal image; and e) a rearwardly directed flange on an inner edge of each of said decorative panels forming a vertically extending channel between said flange, an inner face of one of said side wall members, and a portion of said decorative panel.

2. The display unit defined in claim 1 wherein at least one of said decorative panels includes an opening and further comprising a vertically disposed drawer slidably mounted through said opening into the chamber formed within one of said side wall members between an extended position and a retracted position, said drawer including a vertically oriented display surface visibly exposed when said drawer is in said extended position.

3. The display unit defined in claim 1 further comprising at least one horizontally extending shelf mounted to and extending between said side wall members and configured to receive a display of death care merchandise.

4. The display unit defined in claim 3 wherein said shelf includes a continuous surface having laterally spaced ends, each of said ends being mounted to a respective one of an inwardly facing surface of one of said side panels of a respective one of said side walls.

5. The display unit defined in claim 4 wherein said shelf includes a bottom wall, a pair of laterally spaced side walls connected to said bottom wall and a rear wall connected to and extending between rearward portions of said side walls.

6. The display unit defined in claim 5 further comprising a partial casket display disposed on the bottom wall of said shelf.

7. The display unit defined in claim 5 further comprising a second horizontally disposed shelf disposed in vertically spaced relationship from said first shelf and mounted to and extending between said side panels and configured to receive a display of death care merchandise.

8. The display unit defined in claim 1 further comprising a lighting fixture disposed along the length of said vertically extending channel to direct light into said three-sided alcove configuration.

9. The display unit defined in claim 1 further including a horizontally disposed deck mounted to opposing inwardly facing surfaces of said side wall members and wherein said rear wall is mounted between a rear side of the deck and a support member mounted to an upper portion of each of said side wall members.

10. The display unit defined in claim 9 wherein said deck includes a shelf portion adapted to carry a casket slidably mounted on said deck between retracted and extended positions; and a horizontally disposed stationary shelf mounted to said side wall members above said slidably mounted shelf.

11. The display unit defined in claim 9 including a plurality of vertically disposed divider panels between said wall members and connected to said deck and said support member; and a plurality of horizontally disposed shelves, certain ones of said horizontal shelves being mounted between said divider panels and other ones of said shelves being mounted between one of said divider panels and an adjacent inner surface of a side wall member.

12. A death care product display unit comprising, in combination;

a) a pair of free standing vertical side wall members disposed in parallel, spaced relationship to one another, each of said side wall members comprising a pair of parallel, vertically extending side panels connected to one another in laterally spaced relationship;

b) a pair of shelves, each of said shelves having a horizontally disposed bottom wall having laterally spaced ends, each of said ends mounted to an adjacent side wall member to provide a merchandise supporting display surface, each of said shelves further including a pair of upwardly extending side walls connected to said bottom wall and a rear wall extending upwardly from said bottom wall and having opposing laterally spaced edges connected to said shelf side walls, the rear walls of said pair of shelves having a height sufficient to form a substantially enclosed three-sided alcove configuration with said side wall members;

c) a pair of decorative panels, a respective one of said panels being attached to a frontal edge of a respective one of said side wall members and extending vertically over substantially the entire height of said frontal edge, each of said decorative panels having a width greater than the width of said frontal edge of said side wall member to provide a simulated classical column frontal image; and d) a rearwardly directed flange on an inner edge of each of said panels forming a vertically extending channel between said flange, a portion of an inner face of one of said side wall members and a portion of said panel.

* * * * *